US009918564B2

(12) United States Patent
Paterson

(10) Patent No.: US 9,918,564 B2
(45) Date of Patent: Mar. 20, 2018

(54) INFANT BED FRAME ASSEMBLY AND CHILD BED ASSEMBLY

(71) Applicant: So To Company Ltd, Hexham (GB)

(72) Inventor: Katharine Paterson, Newcastle Upon Tyne (GB)

(73) Assignee: So To Company Ltd, Hexham (GB)

( * ) Notice: Subject to any disclaimer, the term of this patent is extended or adjusted under 35 U.S.C. 154(b) by 765 days.

(21) Appl. No.: 14/398,000

(22) PCT Filed: May 1, 2013

(86) PCT No.: PCT/GB2013/051127

§ 371 (c)(1),
(2) Date: Oct. 30, 2014

(87) PCT Pub. No.: WO2013/164616

PCT Pub. Date: Nov. 7, 2013

(65) Prior Publication Data

US 2015/0113729 A1 Apr. 30, 2015

(30) Foreign Application Priority Data

May 2, 2012 (GB) ..... 1207724.4

(51) Int. Cl.
*A47D 9/00* (2006.01)
*A47D 7/00* (2006.01)
*A47D 7/02* (2006.01)

(52) U.S. Cl.
CPC ..... *A47D 9/00* (2013.01); *A47D 7/00* (2013.01); *A47D 7/02* (2013.01)

(58) Field of Classification Search
CPC ..... A47D 7/00
(Continued)

(56) References Cited

U.S. PATENT DOCUMENTS 5,020,173 A 6/1991 Dreyer, Jr.
5,172,435 A * 12/1992 Griffin ..... A47D 7/04 5/312
(Continued)

FOREIGN PATENT DOCUMENTS

DE 202010000645 U1 5/2010
EP 0679353 A1 11/1995
(Continued)

OTHER PUBLICATIONS

Kis, Pál, "International Search Report," prepared for PCT/GB2013/051127, dated Oct. 7, 2013, eight pages.

*Primary Examiner* — Fredrick C Conley
(74) *Attorney, Agent, or Firm* — Winstead PC

(57) ABSTRACT

The invention relates to a child bed assembly (1) comprising an infant bed frame assembly (10); an inlay (40) for an infant bed; and a toddler bed frame (82). The infant bed frame assembly (10) comprises an upper frame section (12), a base frame portion (14) and at least one connecting member (16) connecting said base frame portion (14) to said upper frame section (12). The upper frame section (12) comprises a first sidebar (18), a second sidebar (20) spaced apart from the first sidebar (18), and a first crossbar (22) coupled to the first and second sidebars (18, 20) proximate a first end of each of said first and second sidebars (18, 20). The upper frame section (12) is pivotally coupled to the at least one connecting member (16) such that the first crossbar (22) is movable between a first position wherein the first crossbar (22) is at a first distance from the base frame portion (14) and a second position wherein the first crossbar (22) is at a second distance from the base frame portion (14).

14 Claims, 25 Drawing Sheets

(58) Field of Classification Search
USPC ..... 5/95, 98.1, 99.1, 100
See application file for complete search history.

(56) References Cited

U.S. PATENT DOCUMENTS

| | | | | |
|---|---|---|---|---|
| 5,715,551 | A | 2/1998 | Proano et al. | |
| 7,216,379 | B2 * | 5/2007 | Tharalson ..... | A47D 5/00 5/93.2 |
| 2003/0126681 | A1 | 7/2003 | Tharalson et al. | |
| 2005/0034232 | A1 | 2/2005 | Martin | |
| 2008/0282468 | A1 | 11/2008 | Golias et al. | |

FOREIGN PATENT DOCUMENTS

| | | | |
|---|---|---|---|
| FR | 1469853 | A | 2/1967 |
| JP | S5669068 | U | 6/1981 |
| WO | WO-0232273 | A1 | 4/2002 |
| WO | WO-2009150736 | A1 | 12/2009 |
| WO | WO-2013164616 | A1 | 11/2013 |

* cited by examiner

Figure 22
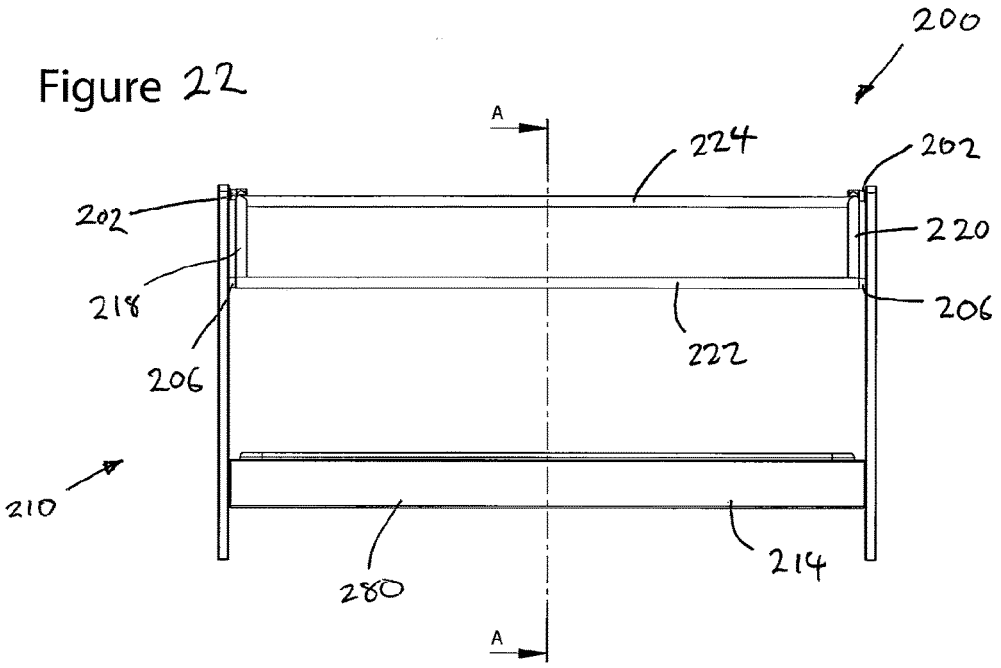
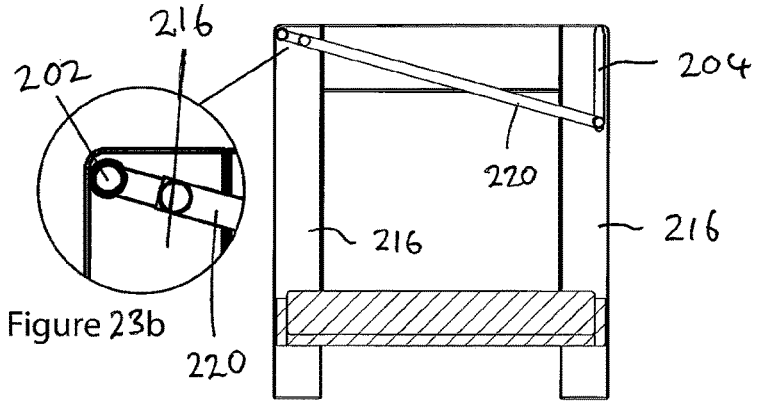
Figure 23b
Figure 23a
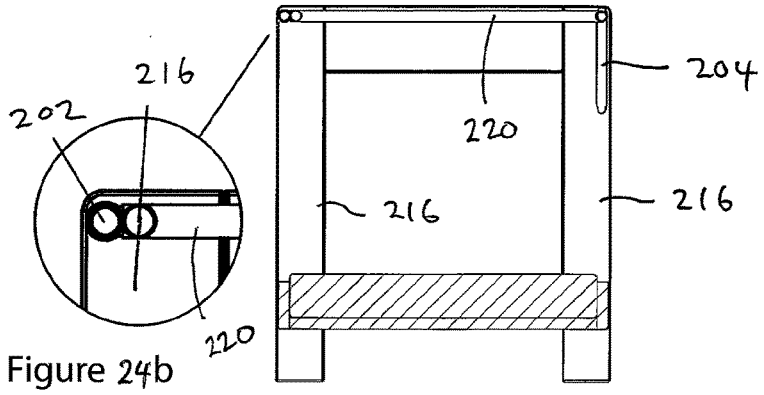
Figure 24b
Figure 24a (a) (b)

INFANT BED FRAME ASSEMBLY AND CHILD BED ASSEMBLY

The present invention relates to a child bed assembly, in particular to an infant bed assembly.

The present invention also relates to an infant bed frame assembly and an inlay for an infant bed.

Traditional infant beds i.e. high-sided child's beds or barred cots, are generally constructed from wood or metal and form an enclosure that prevents a small child from escaping once placed in the enclosure.

The height of the top horizontal element in an infant bed is determined by the minimum distance stated in the safety regulations for it to be from the lowest horizontal element (frame, mattress etc) that could potentially form a foot step for a child once placed within the enclosure of the bed.

Where the lowest horizontal element is at a distance from the ground, the height of the top horizontal element can make it very difficult for an adult to lift the child directly from inside the enclosure. As a result, infant beds commonly have a movable side or sides to facilitate the removal and/or placement of a child within the enclosure.

In order to gain access into the enclosure, the movable side(s) of the infant bed can be released by means of a child proof latch. Once released, the side(s) which is being held in place within a guide is allowed to drop vertically. Once dropped, an adult can more easily lift the child out of the enclosure, place the child in the enclosure or perform other functions such as remake the bed.

The side release mechanisms used on infant beds generally tend to be catches at either end of the droppable side. This is a result of the safety standard requiring a double action release.

The position of the traditional release mechanism can be problematic for a parent when they have a child in their arms as they need two hands to release the droppable side. The parent has to thus release one side then the other but this is burdensome and time consuming. In some designs there is one catch with a two stage mechanism to release the droppable side, which eases this problem.

Furthermore, the safety standards applied to infant beds have resulted in designs that comprise a vertical fence arrangement of gaps and uprights/bars in wood or metal as this reduces the potential of the child to use the uprights/bars as a step to climb out of the enclosure.

However, while the design removes the inadvertent provision of a step which may be used by a child, it creates a hazard where the child can injure itself by falling on to the bars. Also, the design gives rise to the possibility of a user jamming their fingers when the sides are moved into the locked position. Other safety hazards include getting clothing caught in the drop mechanism, and getting limbs stuck through the bars leading to fractures.

To combat the issue of impact injury on the bars, it has been known to fit bumpers in the form of padded panels to the uprights/bars of the infant bed. Bumpers are generally sold as aftermarket accessories as they might void the safety standards of the bed if sold with the infant bed as they could be viewed as a step and can also lead to a potential suffocation hazard.

It is therefore an object of the present invention to obviate or mitigate one or more of the disadvantages of infant beds known in the art.

In a first aspect, the present invention provides an infant bed frame assembly comprising:

an upper frame section;

a base frame portion; and at least one connecting member connecting said base frame portion to said upper frame section;

said upper frame section comprising a first sidebar, a second sidebar spaced apart from the first sidebar, and a first crossbar coupled to said first and second sidebars proximate a first end of each of said first and second sidebars;

wherein said upper frame section is pivotally coupled to said at least one connecting member such that said first crossbar is movable between a first position wherein said first crossbar is at a first distance from the base frame portion and a second position wherein said first crossbar is at a second distance from the base frame portion.

By means of the invention, an infant bed frame assembly is provided in which it is not necessary to utilize the vertical fence arrangement known in the art thus avoiding the disadvantages associated with said design.

Furthermore, by pivotally coupling the upper frame section such that the first crossbar is movable from a first position towards a second position, the risk of a user jamming their fingers when moving the side of the infant bed to gain access to the enclosure is reduced.

In preferred embodiments, the first crossbar extends substantially between the first sidebar and the second sidebar.

In exemplary embodiments, the upper frame section further comprises a second crossbar opposite the first crossbar, said second crossbar being coupled to said first and second sidebars.

Preferably said first and second sidebars and said first and second crossbars define a substantially rectangular upper frame section.

In exemplary embodiments comprising a second crossbar, preferably the upper frame section is pivotally coupled to said at least one connecting member proximate to the second crossbar.

In exemplary embodiments, the first crossbar is lockable in said first position and the infant bed frame assembly further comprises at least one release mechanism adapted to release the first crossbar from a locked first position so as to be movable towards the second position.

The first crossbar may also be lockable in said second position, with the at least one release mechanism being also adapted to release the first crossbar from the locked second position.

Preferably, the at least one release mechanism comprises an auto reset function adapted to move the first crossbar from the second position towards a locked first position.

In exemplary embodiments, the infant bed frame assembly further comprises at least one locking strut adapted to lock the first crossbar in the first position and/or the first crossbar in the second position.

Preferably the at least one locking strut is in the form of a telescopic tube mechanism.

In exemplary embodiments comprising at least one locking strut, the infant bed frame assembly may comprise a centrally positioned locking strut. Alternatively, the infant frame assembly may comprise a pair of locking struts, each locking strut positioned proximate an end of the first crossbar.

In exemplary embodiments, the infant bed frame assembly has a pair of connecting members at a posterior of the infant bed frame assembly. The infant bed frame assembly may further have a pair of connecting members at an anterior of the infant bed frame assembly.

In a second aspect, the present invention provides an inlay for an infant bed comprising:

a base layer;

at least one wall section upstanding from said base layer, said at least one wall section and said base layer defining an enclosure in which a child may be placed; and an opening opposite said base layer for allowing access to said enclosure;

wherein a portion of said at least one wall section is foldable so as transform the inlay between a first configuration wherein the opening is at a first height from the base layer and a second configuration wherein the opening is at a second height from the base layer.

Optionally, a further portion of said at least one wall section is at least partially reinforced so as to substantially maintain its shape when the inlay is transformed between the first configuration and the second configuration.

In exemplary embodiments, the inlay comprises a fabric material. Preferably the inlay comprise a mixed fabric and mesh material.

The advantage to the fabric and mesh material is that it is soft and breathable.

In an exemplary embodiment, the inlay further comprises a plurality of fasteners to temporarily secure the inlay in the second configuration.

The fasteners may be any suitable fasteners for example hook-and-loop fasteners, releasable clasp fasteners, button fasteners, zip fasteners etc. or a combination thereof. In preferred embodiments, the plurality of fasteners comprises at least one zip fastener and/or at least one snap fastener.

In exemplary embodiments, the inlay comprises at least two types of fasteners.

Conveniently, the base layer is adapted to receive and support a mattress.

In exemplary embodiments, in the first configuration the inlay is in a high-sided child's bed configuration.

In exemplary embodiments, in the second configuration the inlay is in a bassinet configuration.

In a third aspect, the present invention provides a child bed assembly comprising:

an infant bed frame assembly according to a first aspect of the invention;

an inlay for an infant bed; and a toddler bed frame.

Preferably the inlay is an inlay according to a second aspect of the invention. Thus the invention according to the third aspect of the invention can provide a bed assembly which can be used for a child from birth to toddler as it can be arranged to be a bassinet, a high-sided child's bed or a toddler bed.

In exemplary embodiments, the base frame portion of the infant bed frame assembly comprises the toddler bed frame.

Preferably the child bed assembly further comprises a mattress.

In exemplary embodiments, the child bed assembly further comprises a headboard adapted to be coupled to the toddler bed frame.

Throughout the description and claims of this specification, the words "comprise" and "contain" and variations of the words, for example "comprising" and "comprises", means "including but not limited to", and is not intended to (and does not) exclude other components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Embodiments of the invention will now be described, by way of example only, with reference to the accompanying drawings, in which:

FIG. 22 is a front view of a third embodiment of an infant bed frame assembly according to the invention with the first crossbar in the second position;

Figure 25:
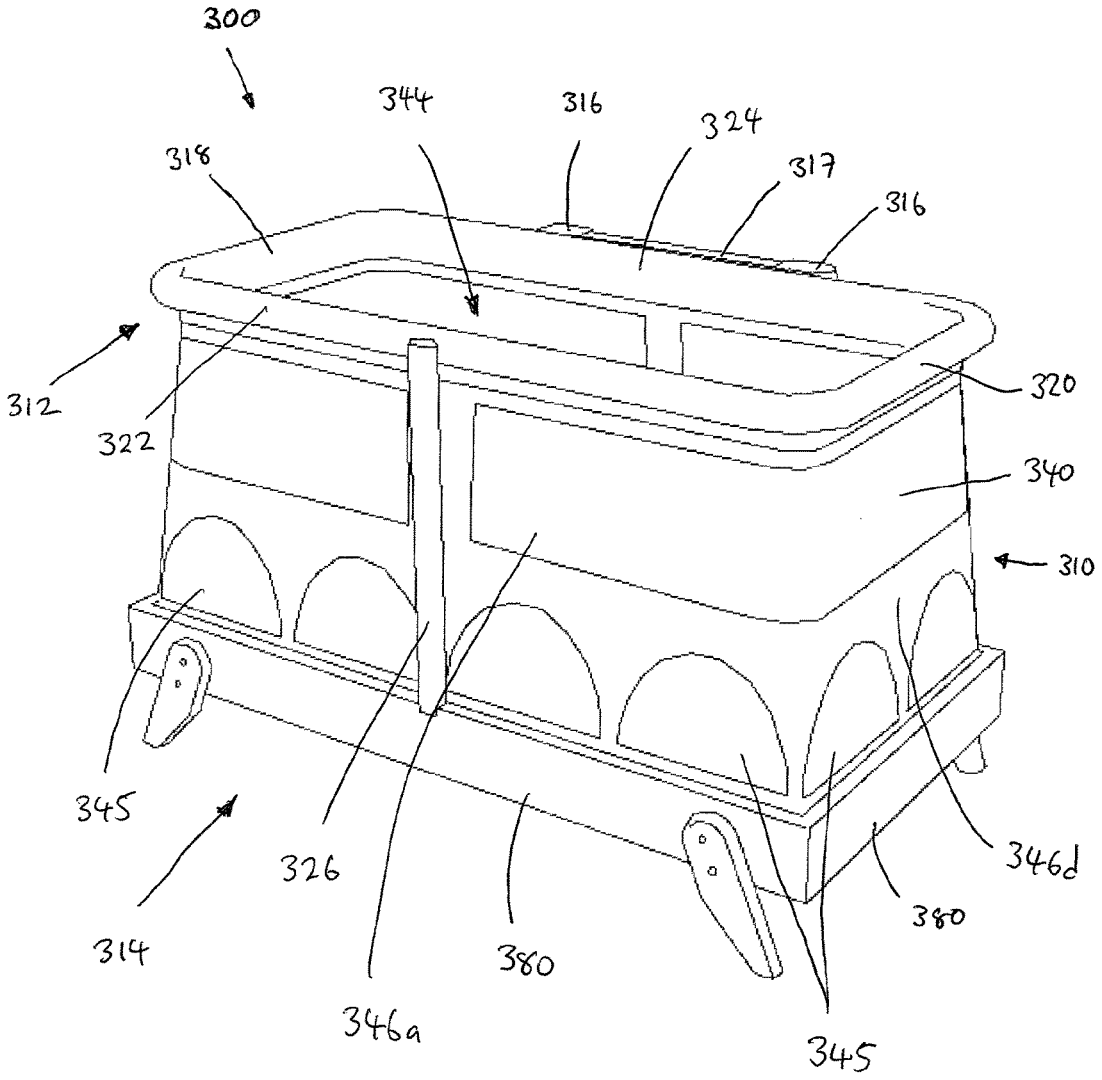
Figure 26:
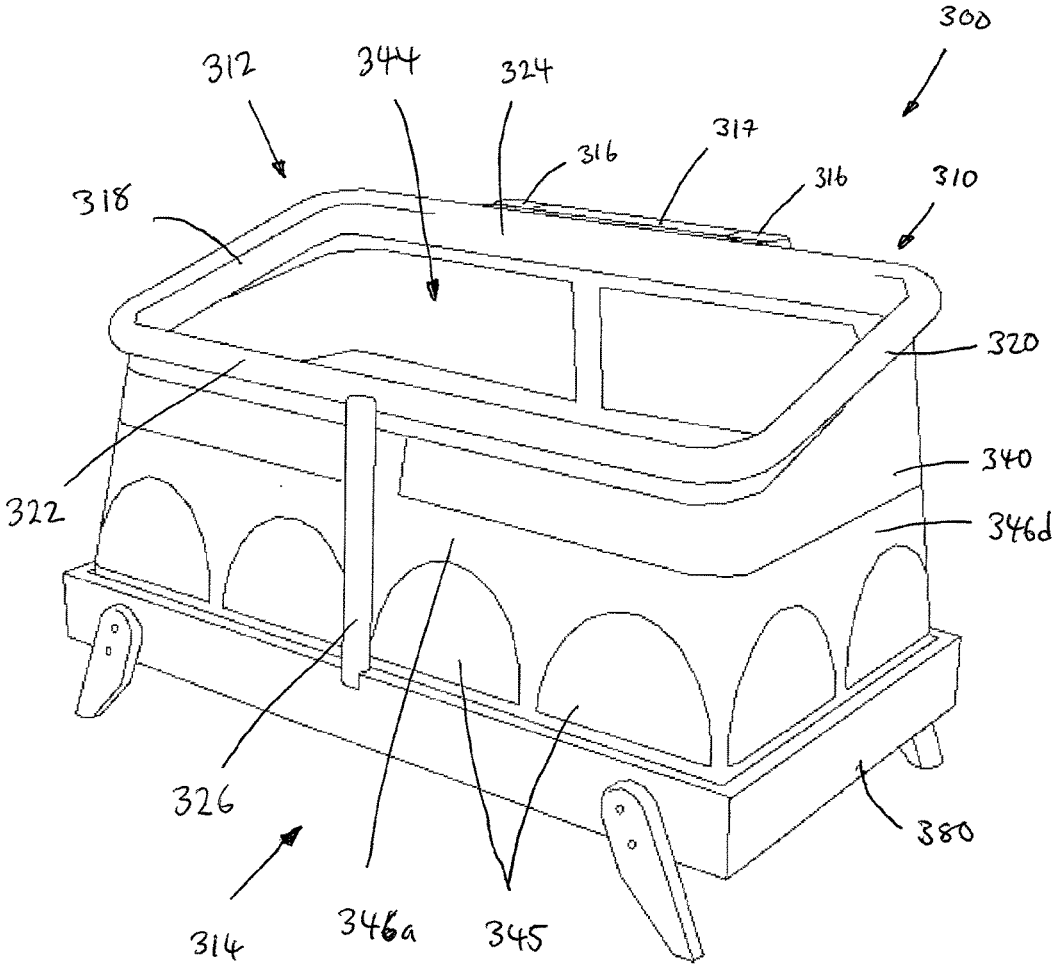
Figure 27:
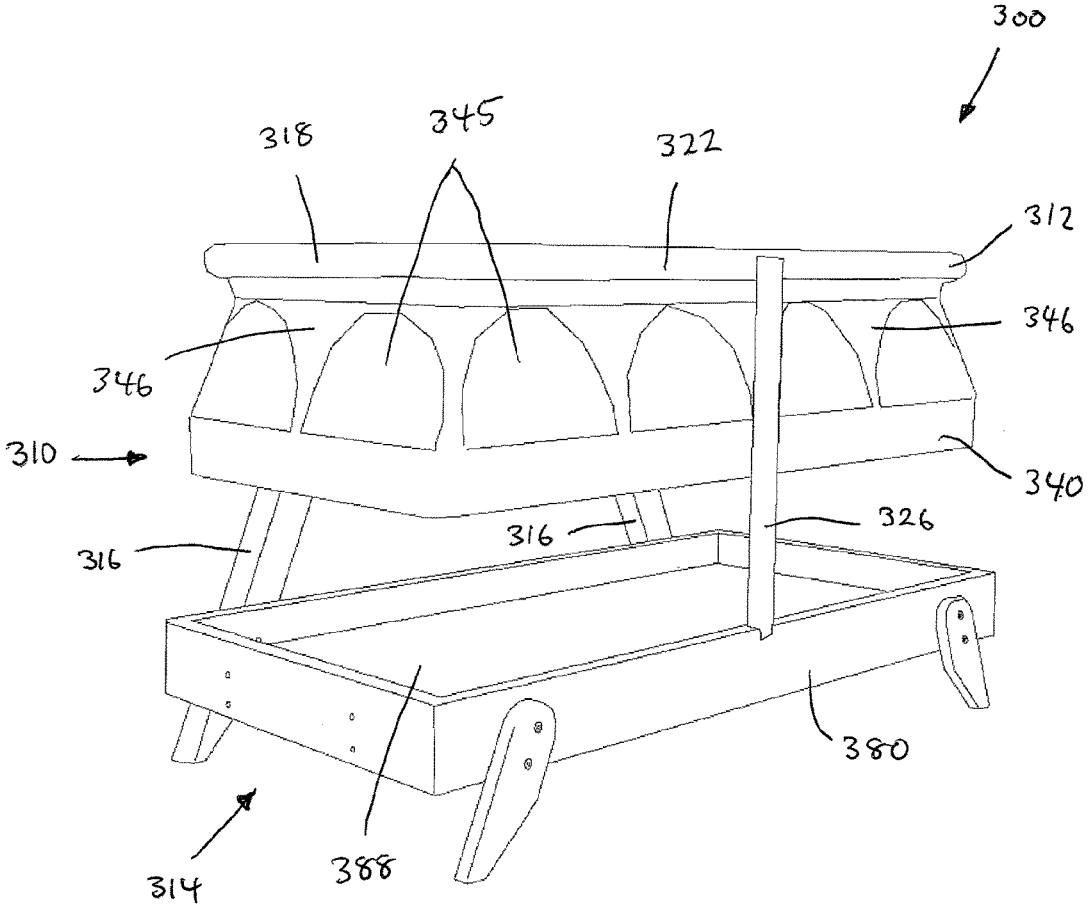
Figure 28:
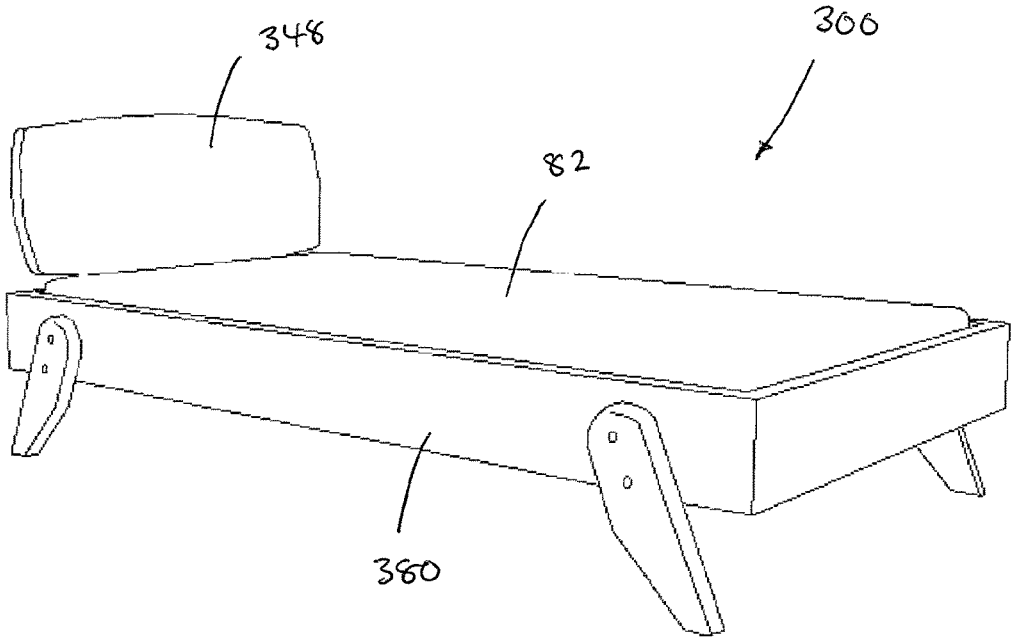
Figure 29:
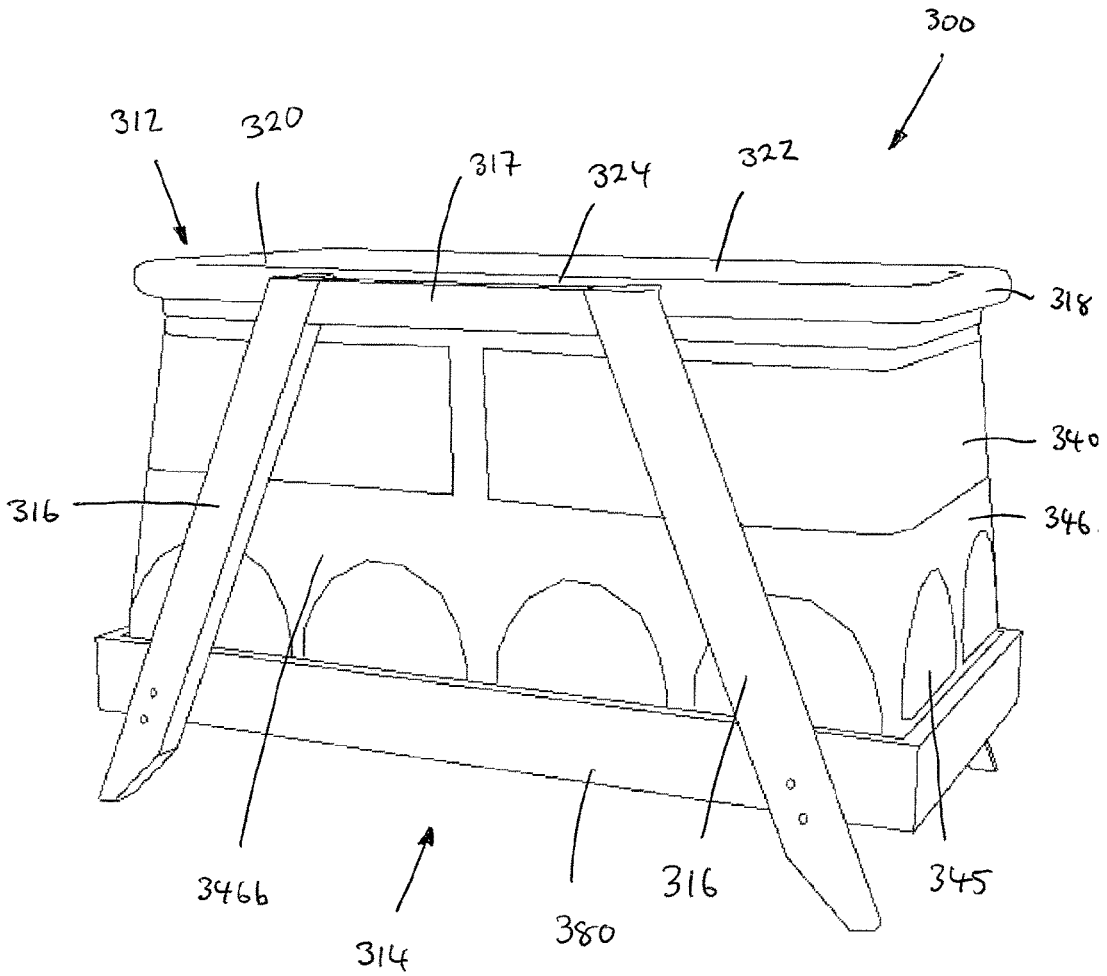
Figure 30:
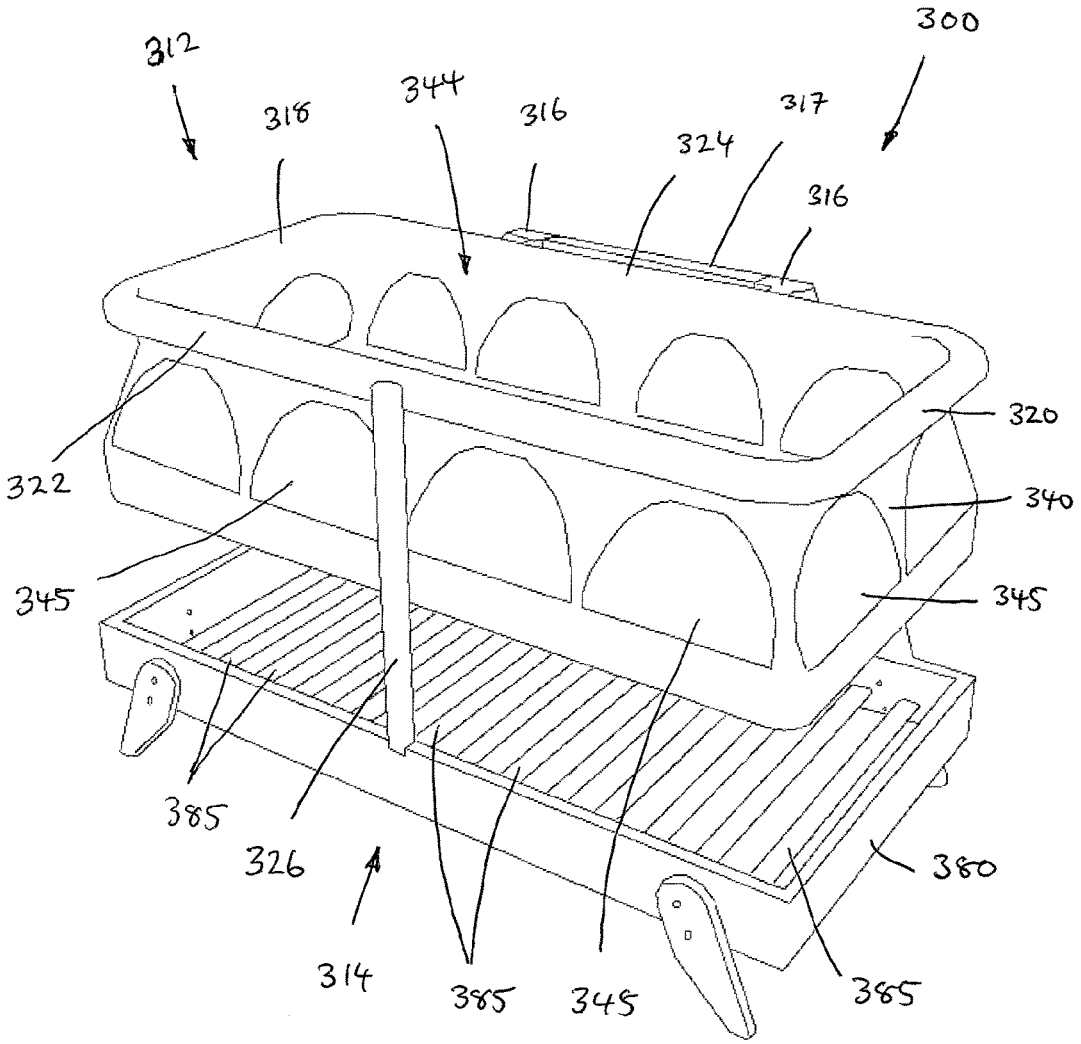
Figure 31:
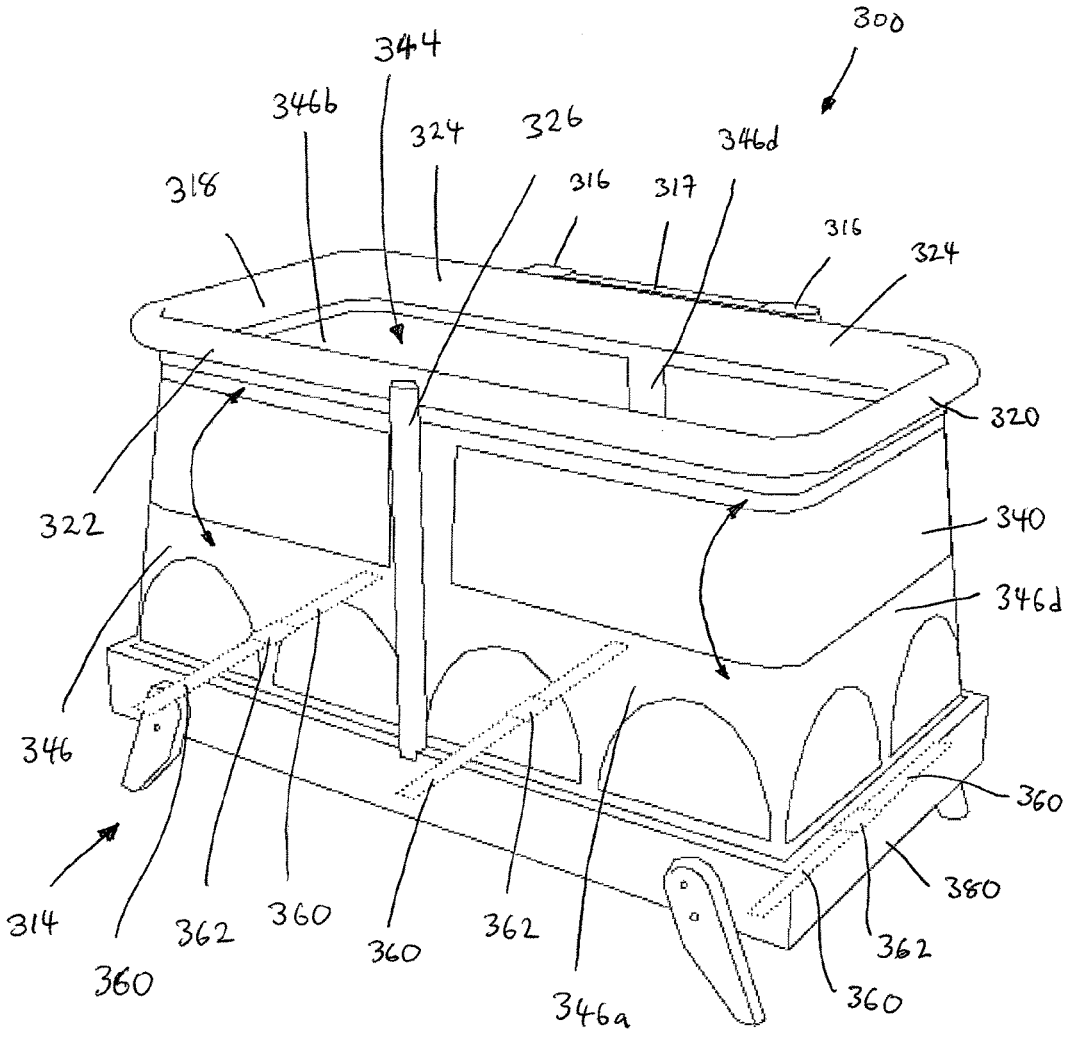
Figure 32:
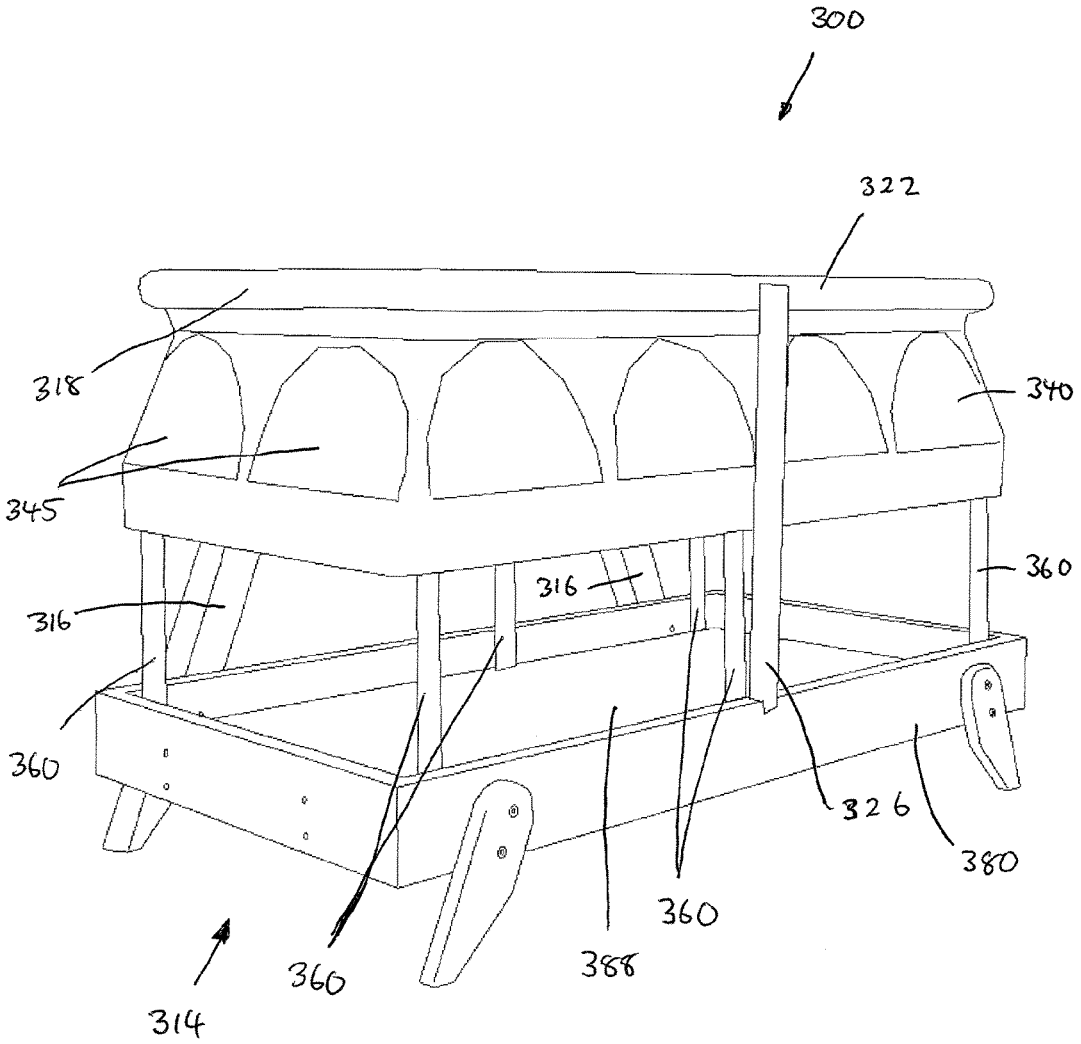
Figure 33:
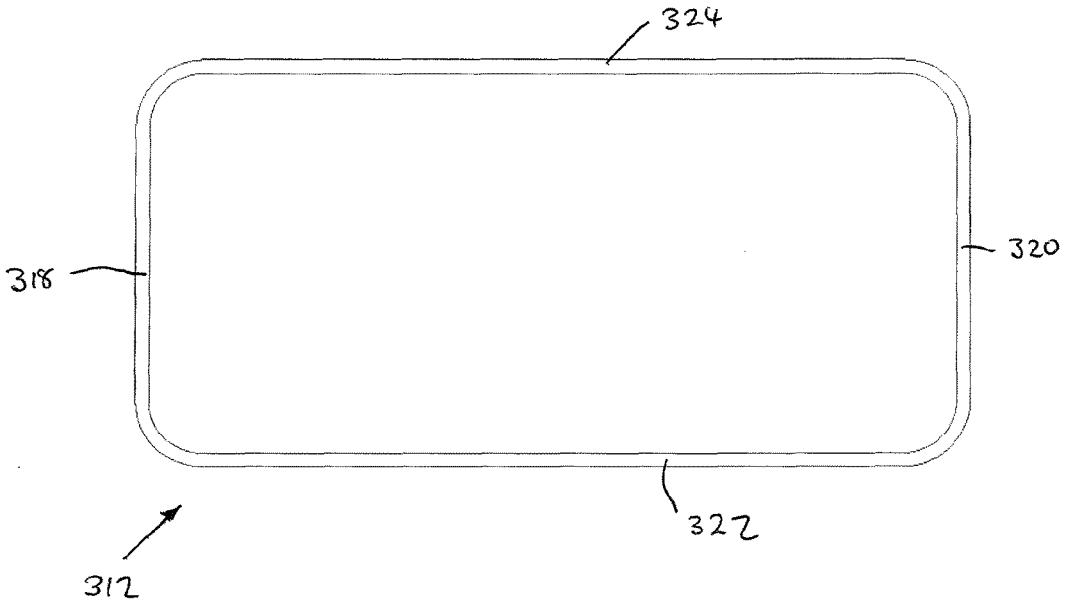
Figure 34:
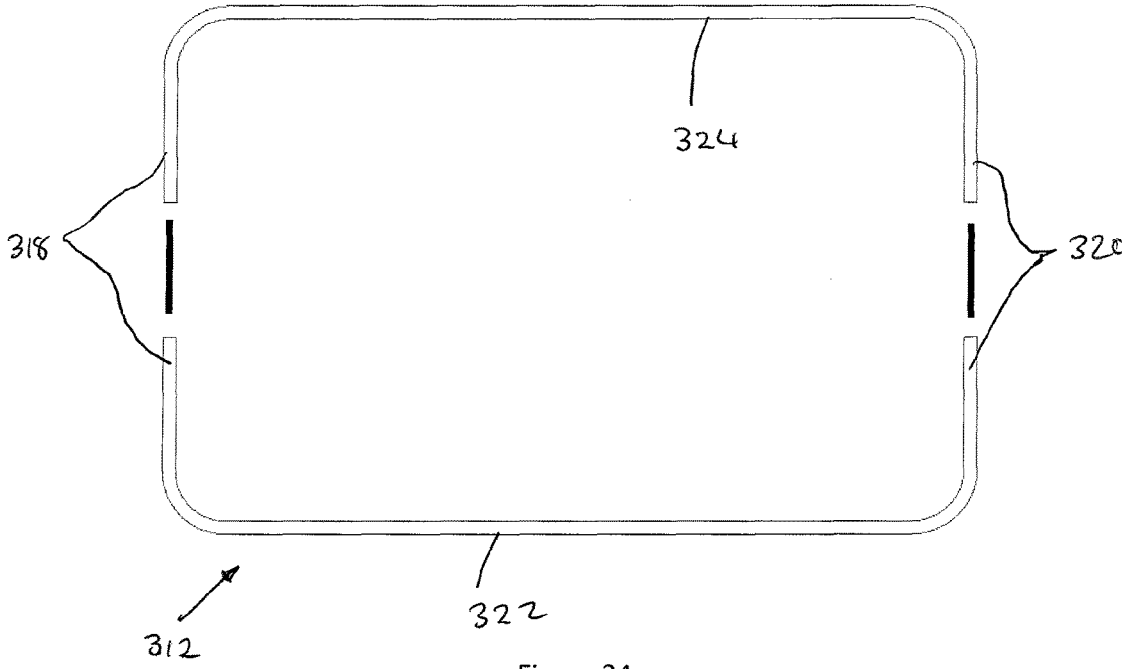
Figure 35:
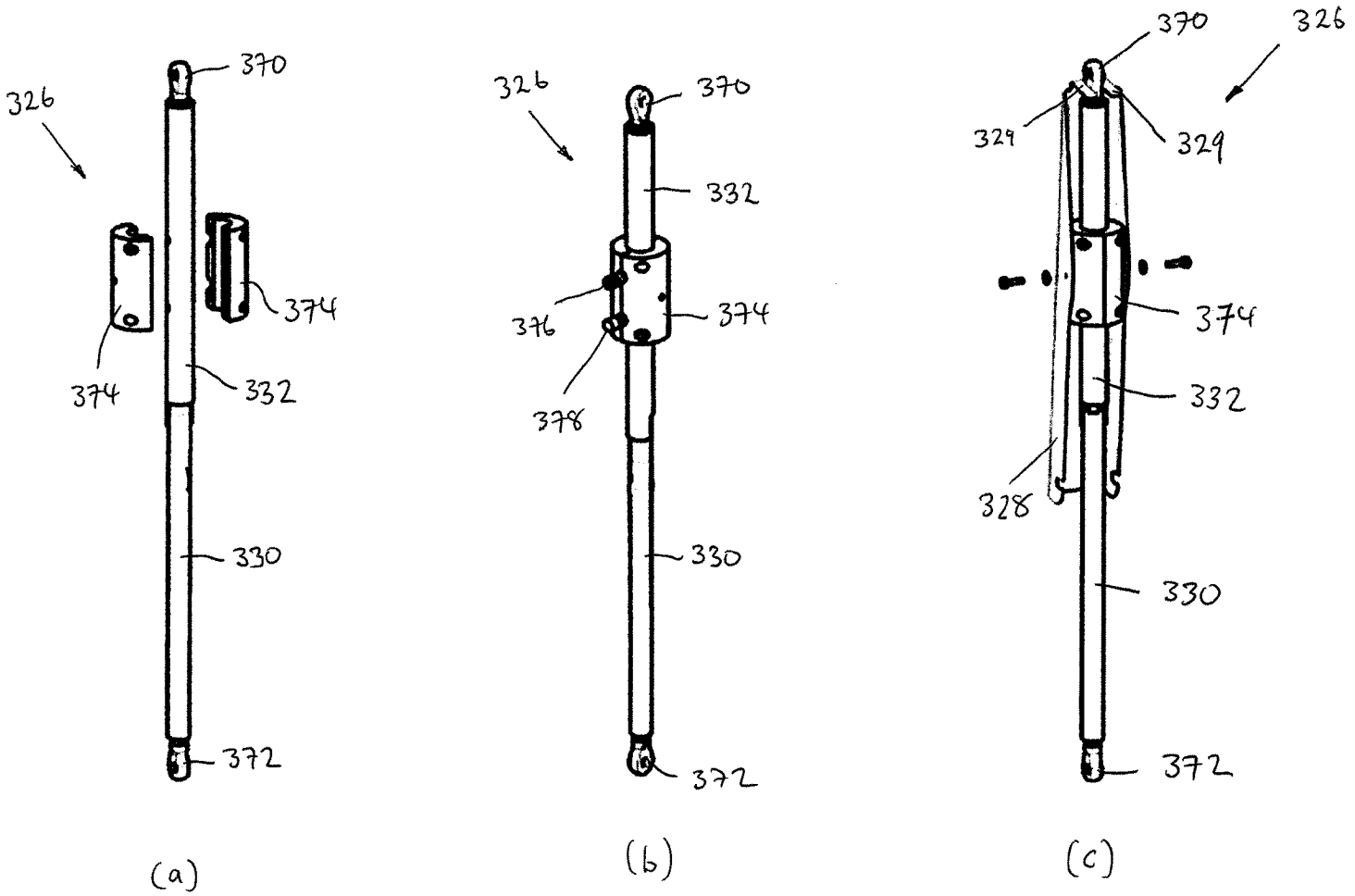
Figure 36:
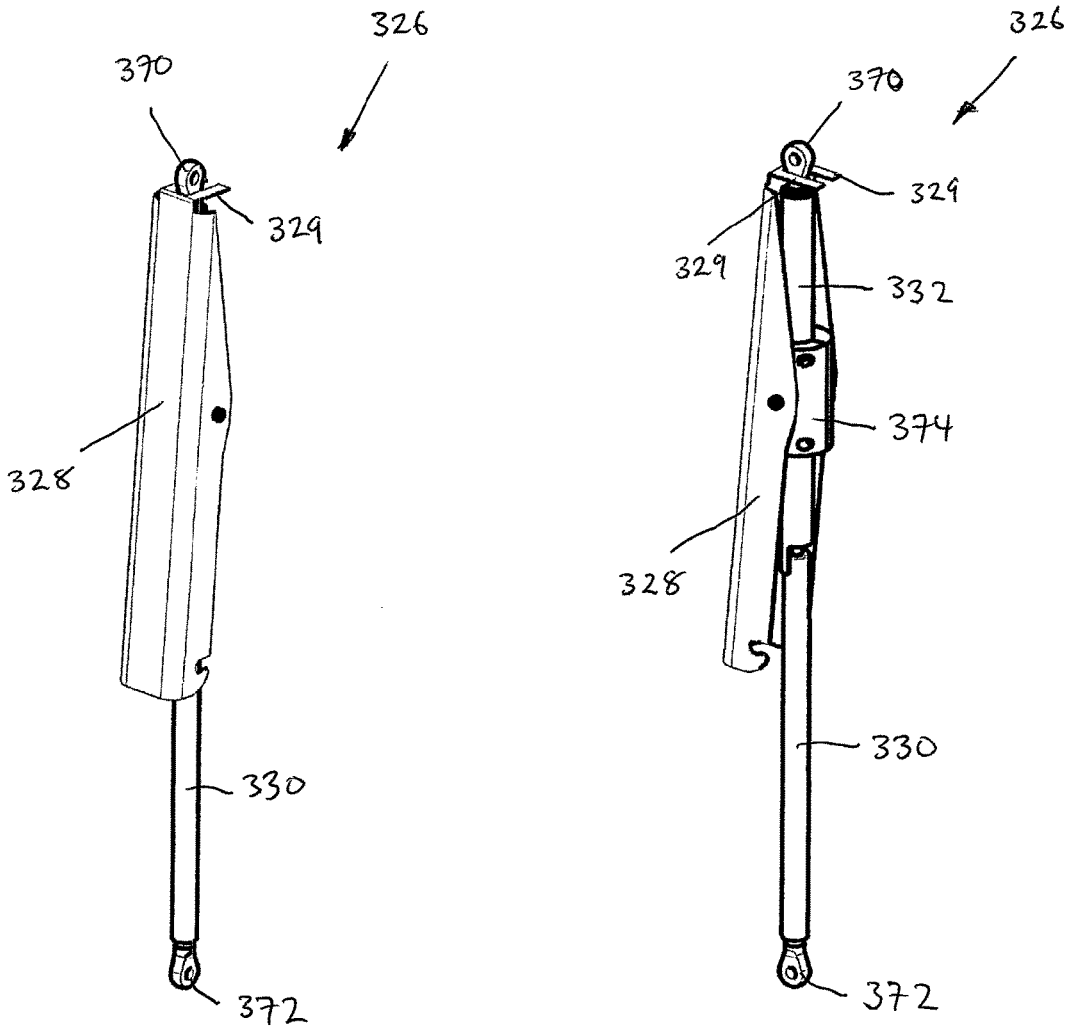
Figure 37:
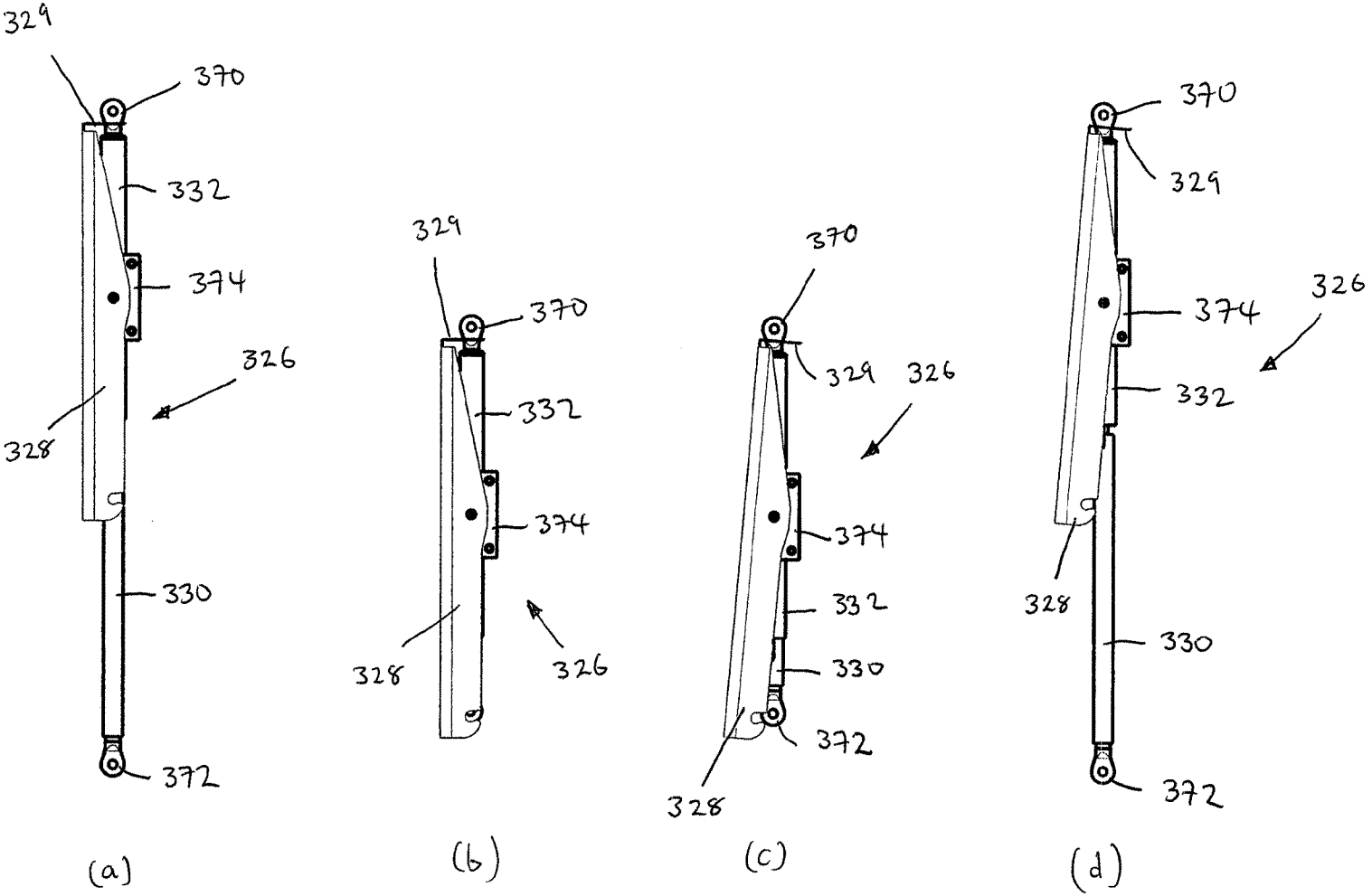
Figure 38:
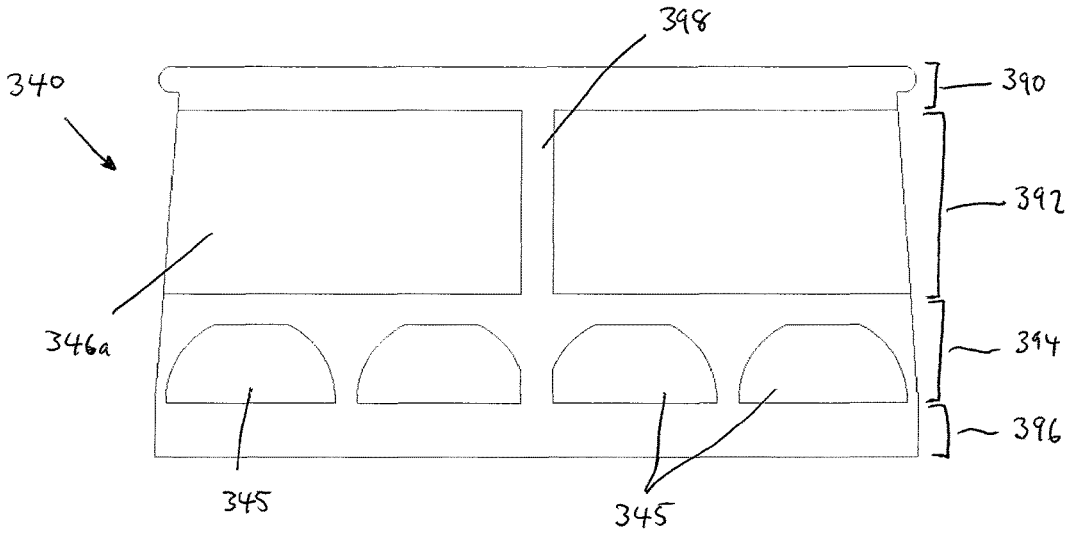
Figure 39:
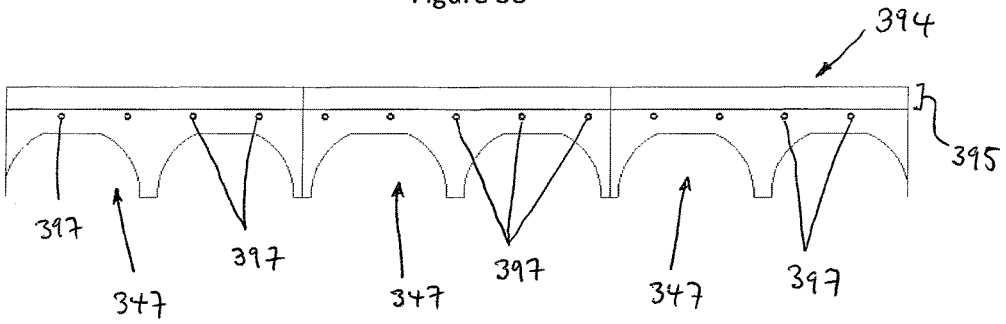
Figure 40:
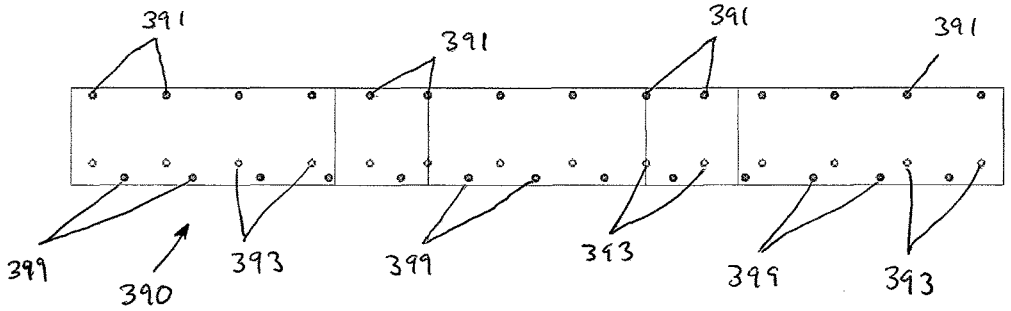
Figure 41:
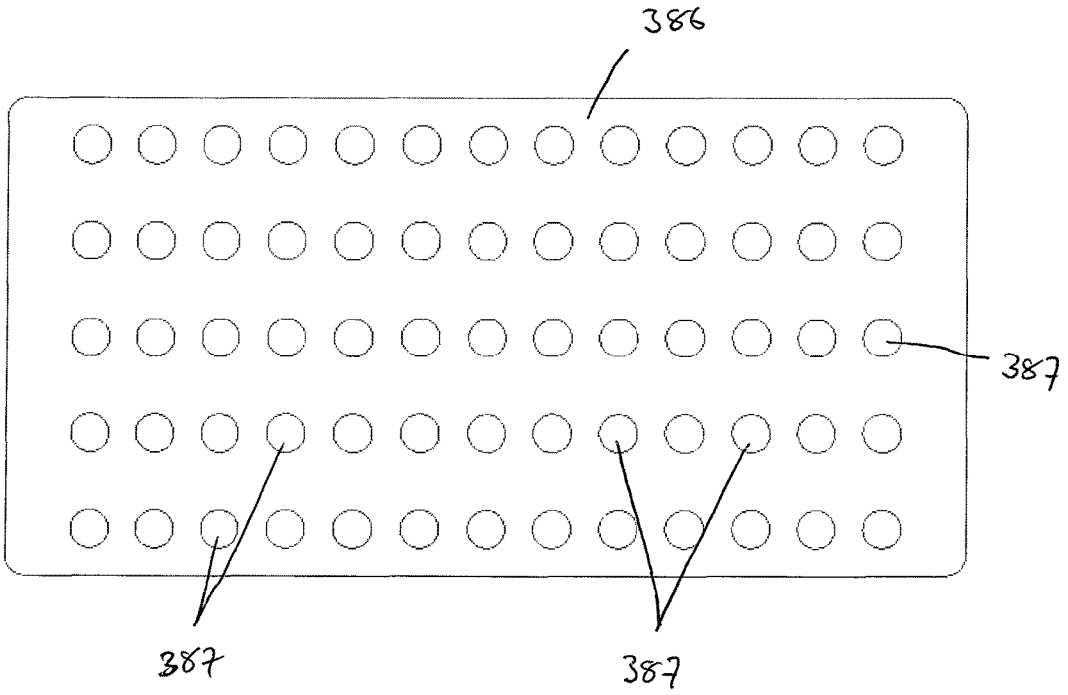
Figure 42:
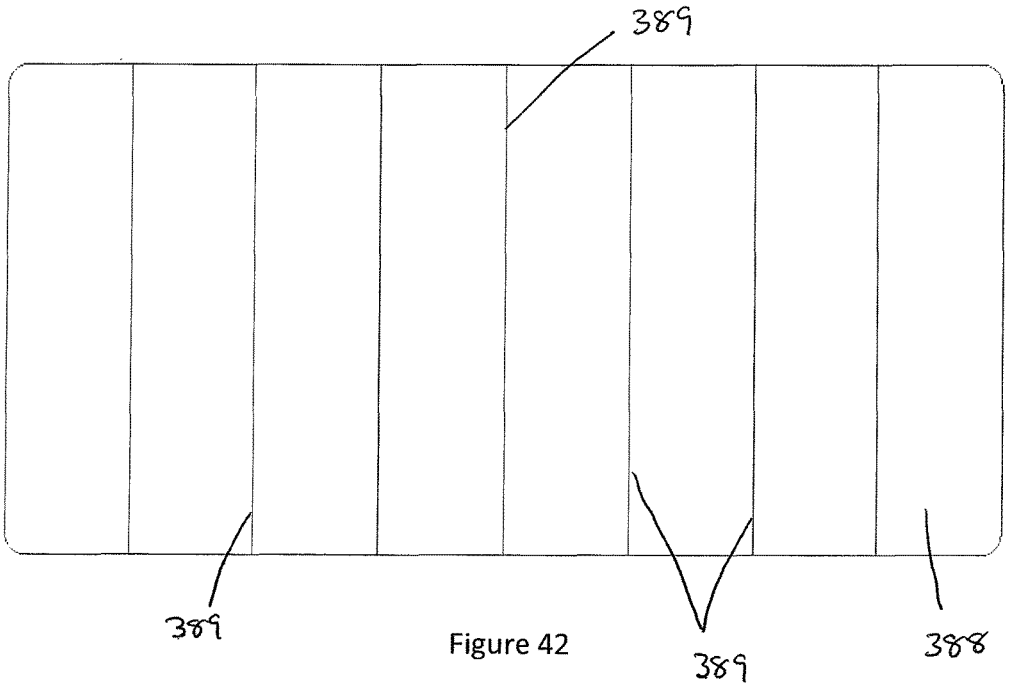

FIG. 23*a* is a cross-sectional view of the embodiment of FIG. 22 taken along line A-A;

FIG. 23*b* is an enlarged view of an end of the side bar of the embodiment of FIG. 22 when the first crossbar is in the second position;

FIG. 24*a* is a similar cross-sectional view of the embodiment of FIG. 22 with the first crossbar in the first position;

FIG. 24*b* is an enlarged view of an end of the side bar of the embodiment of FIG. 22 when the first crossbar is in the first position;

FIG. 25 depicts a perspective view of a third embodiment of a child bed assembly according to the invention in the high-sided child's bed configuration with the first crossbar in the first position;

FIG. 26 depicts a perspective view of the third embodiment of a child bed assembly according to the invention in the high-sided child's bed configuration with the first crossbar in the second position;

FIG. 27 depicts a perspective view of the third embodiment of a child bed assembly according to the invention in the bassinet configuration;

FIG. 28 depicts a perspective view of the third embodiment of a child bed assembly according to the invention in the toddler bed configuration;

FIG. 29 depicts a perspective view of the configuration of FIG. 25 from the rear;

FIG. 30 is a similar view to FIG. 27 showing the omission of the cover on the base frame portion;

FIG. 31 is a perspective view showing the connection of the webbing when the child bed assembly is in the high-sided child's bed configuration;

FIG. 32 is a perspective view showing the connection of the webbing when the child bed assembly is in the bassinet configuration;

FIG. 33 is a schematic view of an embodiment of the upper frame section of the infant bed frame assembly of the embodiment of FIG. 25;

FIG. 34 is a schematic view of another embodiment of an upper frame section of the infant bed frame assembly of the embodiment of FIG. 25;

FIG. 35 shows the construction of the locking strut and release mechanism forming part of the child bed assembly of FIG. 25;

FIG. 36 shows the assembled locking strut and release mechanism of FIG. 35;

FIG. 37 shows the locking strut and release mechanism of FIG. 35 in different positions;

FIG. 38 shows a front view of an embodiment of an inlay forming part of the child bed assembly of FIG. 25;

FIG. 39 depicts an embodiment of a part forming a half of the fabric portion of the second middle section of the inlay of FIG. 38;

FIG. 40 depicts an embodiment of a part forming a half of the top section of the inlay of FIG. 38;

FIG. 41 is a schematic view of bassinet base forming part of the child bed assembly of the invention; and FIG. 42 is a schematic view of a cover forming part of the child bed assembly of the invention.

While the invention is susceptible to various modifications and alternative forms, specific embodiments thereof are shown by way of example in the drawings and will herein be described in detail. It should be understood that the drawings and detailed description thereto are not intended to limit the invention to the particular form disclosed, but on the contrary, the intention is to cover all modifications, equivalents and alternatives falling within the scope of the invention as defined by the appended claims.

Further, although the invention will be described in terms of specific embodiments, it will be understood that various elements of the specific embodiments of the invention will be applicable to all embodiments disclosed herein.

In the drawings, similar features are denoted by the same reference signs throughout.

Referring to FIGS. 1 to 15 of the drawings, a first embodiment of a child bed assembly according to the invention is illustrated, generally indicated by reference numeral 1.

The child bed assembly (1) comprises an infant bed frame assembly (10), an inlay (40) for an infant bed, and a toddler bed frame (80).

The toddler bed frame (80) is adapted to hold a mattress (82) such that a majority of the mattress (82) is housed within the toddler bed frame (82). The toddler bed frame (80) is similar to those known in the art and as such will not be discussed in any further detail.

The infant bed frame assembly (10) comprises an upper frame section (12), a base frame portion (14) and at least one connecting member (16) connecting the base frame portion (14) to the upper frame section (12). In the embodiment shown, the infant bed frame assembly (10) comprises two connecting members (16) located at the posterior of the infant bed frame assembly (10).

The upper frame section (12) comprises a first sidebar (18), a second sidebar (20), a first crossbar (22) and a second crossbar (24).

The first and second sidebars (18, 20) are spaced apart from each other and are arranged in a substantially parallel arrangement. The first and second crossbars (22, 24) extend substantially between the first and second sidebars (18, 20) with the first crossbar (22) coupled to the first and second sidebars (18, 20) proximate a first end of each of the first and second sidebars (18, 20) and the second crossbar (24) coupled to the first and second sidebars (18, 20) proximate a second end of each of the first and second sidebars (18, 20). As a result, the first and second sidebars (18, 20) and the first and second crossbars (22, 24) together define a substantially rectangular upper frame section (12).

Figure 1:
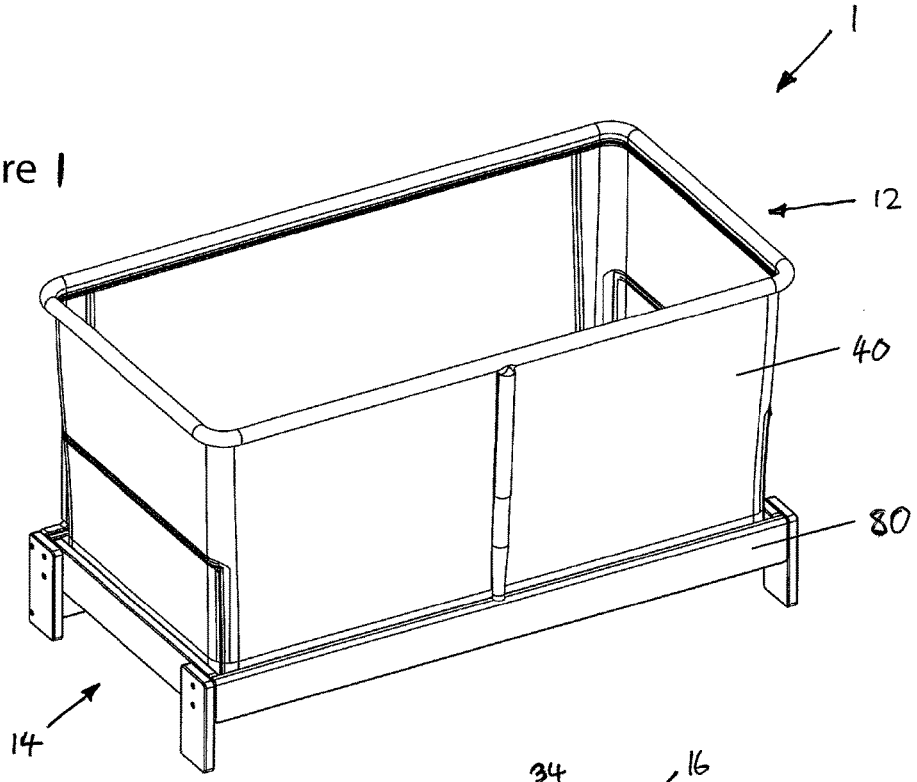
FIG. 1 depicts a perspective view of a first embodiment of a child bed assembly according to the invention.
Figure 2:
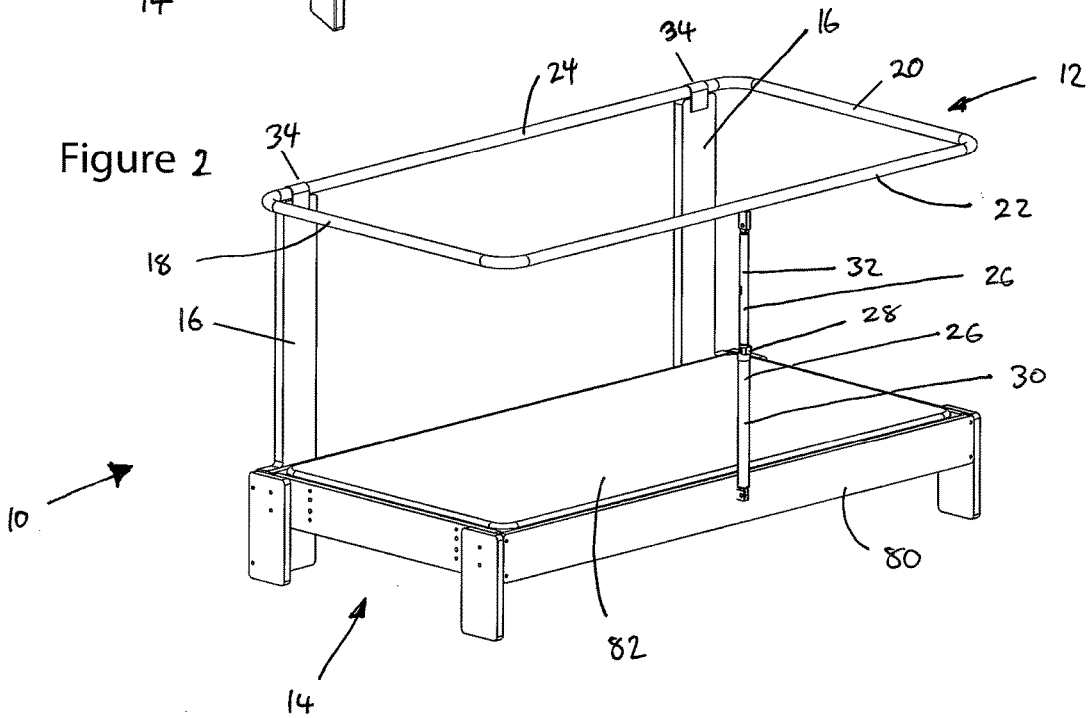
FIG. 2 depicts a perspective view of a first embodiment of an infant bed frame assembly according to the invention with the first crossbar in the first position.
Figure 3:
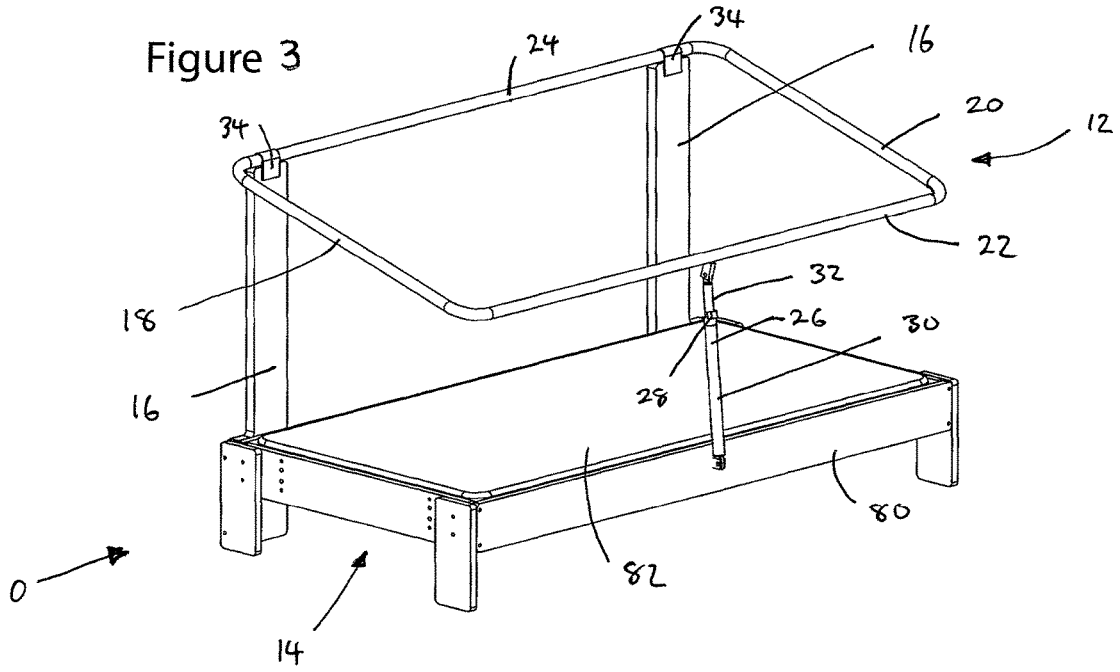
FIG. 3 is a perspective view of the embodiment of FIG. 2 with the first crossbar in the second position.
Figure 4:
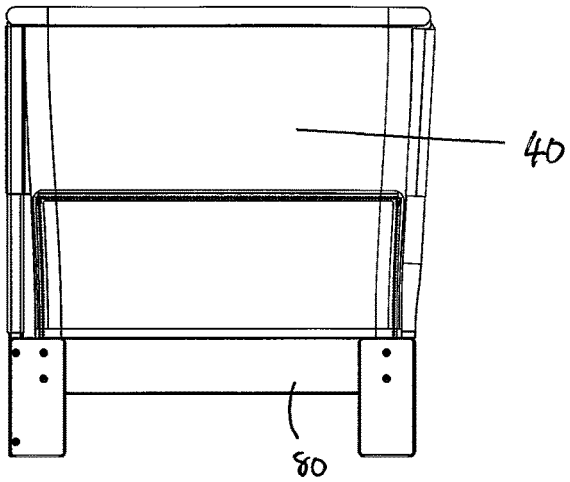
FIG. 4 is a side view of the embodiment of FIG. 1.
Figure 5:
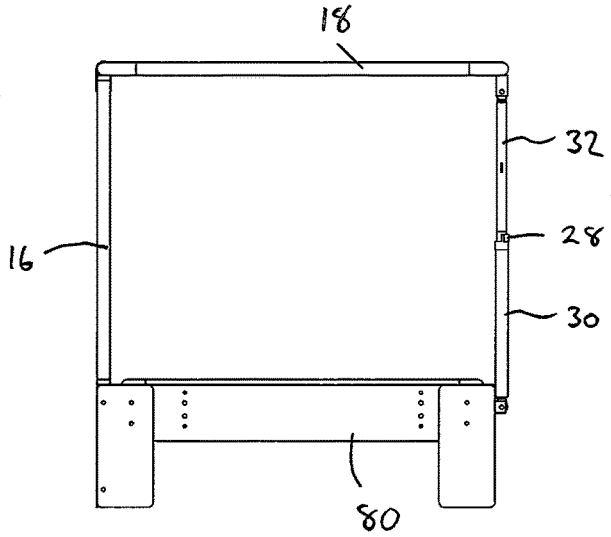
FIG. 5 is a side view of the embodiment of FIG. 2.
Figure 6:
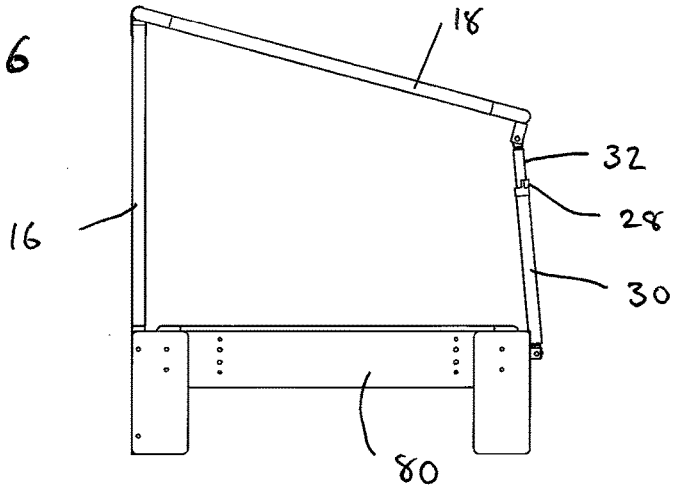
FIG. 6 is a side view of the embodiment of FIG. 3.

The upper frame section (12) is pivotally coupled to the connecting members (16) at the second crossbar (24) by means of hinges (34) such that the first crossbar (22) is movable between a first position wherein the first crossbar is at a first distance from the base frame portion (14) (as shown in FIG. 2) and a second position wherein the first crossbar (22) is at a second distance from the base frame portion (14) (as shown in FIG. 3).

In the embodiment shown, in the first position, the first crossbar (22) and second crossbar (24) are substantially in the same horizontal plane. In this configuration, in use, the components of the upper frame assembly (12) will be at a height such that it is difficult for an infant placed in the bed from climbing out of the bed unassisted.

In the second position, the first crossbar (22) is lower that the second crossbar (24) thus allowing easier access for a user in to the enclosure.

The infant frame assembly (10) further comprises a locking strut (26) adapted to lock the first crossbar (22) in the first position. In the embodiment shown, the locking strut (26) is in the form of a telescopic tube mechanism, although it may take other suitable forms. The locking strut (26) may also be adapted to lock the first crossbar (22) in the second position.

The telescopic tube mechanism (26) comprises a fixed tube section (30) and a sliding tube section (32). An end of the sliding tube section (32) is coupled to the first crossbar (22) and an opposite end of the sliding tube section (32) is received within an end of the fixed tube section (30). An opposite end of the fixed tube section (30) is coupled to the base frame portion (14).

As can be seen, the locking strut (26) is centrally positioned relative to each end of the first crossbar (22).

The infant bed frame assembly further comprises a release mechanism (28) associated with the locking strut (26). The release mechanism is adapted to release the first crossbar (22) from a locked position so as to be movable towards the second position or first position as required.

In the embodiment shown, the release mechanism (28) is in the form of a push button which when activated allows the sliding tube section (32) to move relative to the fixed tube section (30). Such mechanisms are known in the art and would therefore not be described in any further detail.

In use, in order to move the first crossbar (22) to the second position, a user simply presses the release mechanism (28) and then pushes the first crossbar (22) in a downwards direction. This provides the double action release required under the safety standards.

Due to the fact that the locking strut (26) is centrally positioned, the push button of the release mechanism (28) can be activated by a user's knee when they have a child in their arms, thus only requiring one free hand to release and push the first crossbar (22) towards the second lowered position.

An auto reset function is incorporated in the locking strut (26) which will move the first crossbar (22) from the second position or a lowered position towards the first locked position. The auto reset function might be accomplished by means of a spring-like mechanism or hydraulic mechanism which raises the sliding tube section (32) out of the fixed tube section (30).

If the first crossbar (22) is in a locked second position, the release mechanism (28) would need to be first activated for the auto reset function to function.

With particular reference to FIGS. 7 to 12, the inlay (40) comprises a base layer (42), an opening (44) opposite the base layer (42) and at least one wall section (46) upstanding from the base layer (42). The base layer (42) is adapted to receive the mattress (82) thereon. In the embodiment shown, the inlay (40) comprises four wall sections (46*a-d*) upstanding from the base layer (42).

Figure 7:
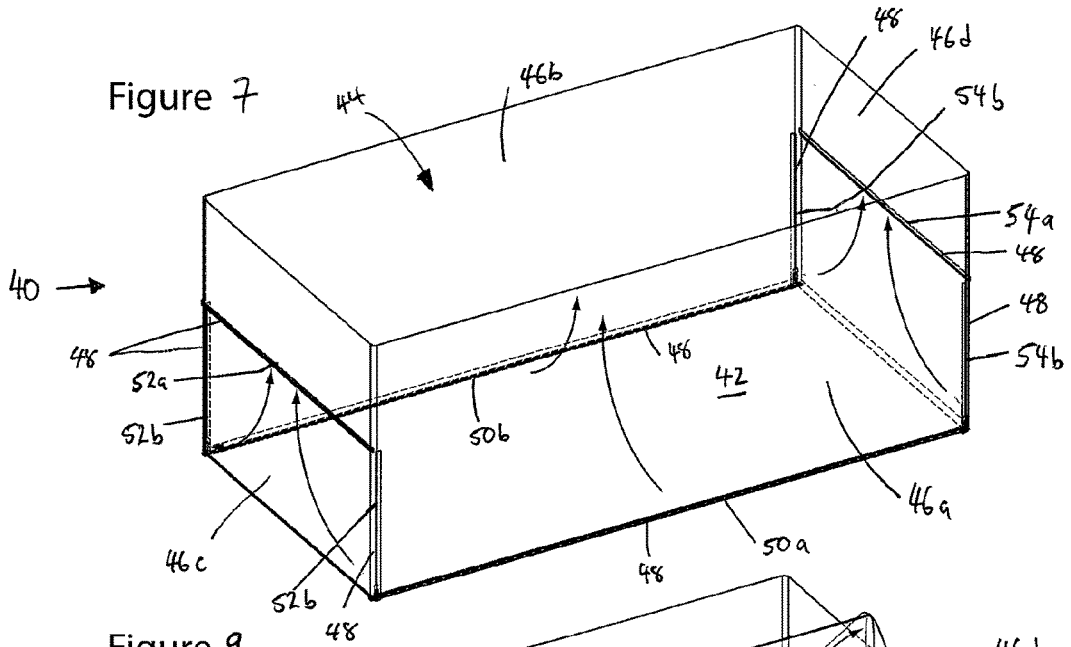
FIG. 7 depicts a perspective view of an embodiment of an inlay for an infant bed in accordance with the invention in the first configuration.

A portion of each of the wall sections (46) is foldable so as to transform the inlay (40) between a first configuration wherein the opening (44) is at a first height from the base layer (42) (as shown in FIG. 7) and a second configuration wherein the opening is at a second height from the base layer (42).

The inlay (40) preferably comprises a fabric and mesh material but may be of any other suitable materials.

The inlay further comprises a plurality of fasteners (48), which in the embodiment shown are in the form of zip fasteners, to temporarily secure the inlay (40) in the second configuration as required.

Three zip fasteners (50, 52, 54) are used, although it would be understood by a person skilled in the art that more or less than three zip fasteners may be used to temporarily secure the inlay (40) in the second configuration.

A first track (50*a*) of the first zip fastener (50) is positioned on the lower horizontal edge of the first wall section (46*a*) and the second track (50*b*) of the first zip fastener (50) is on the lower horizontal edge of the second wall section (46*b*) opposite the first wall section (46*a*).

The first track (52*a*) of the second zip fastener (52) is positioned on the third wall section (46*c*) at a predetermined height and substantially parallel to the upper horizontal edge of the third wall section (46*c*). The second track (52*b*) of the second zip fastener (52) is in two parts with a part positioned along opposite vertical edges of the third wall section (46*c*) and below the first track (52*a*).

The first and second tracks (54*a*, 54*b*) of the third zip fasteners (54) are located in similar positions along the fourth wall section (46*d*) as the first and second tracks (52*a*, 52*b*) of the second zip fasteners (52).

Figure 8:
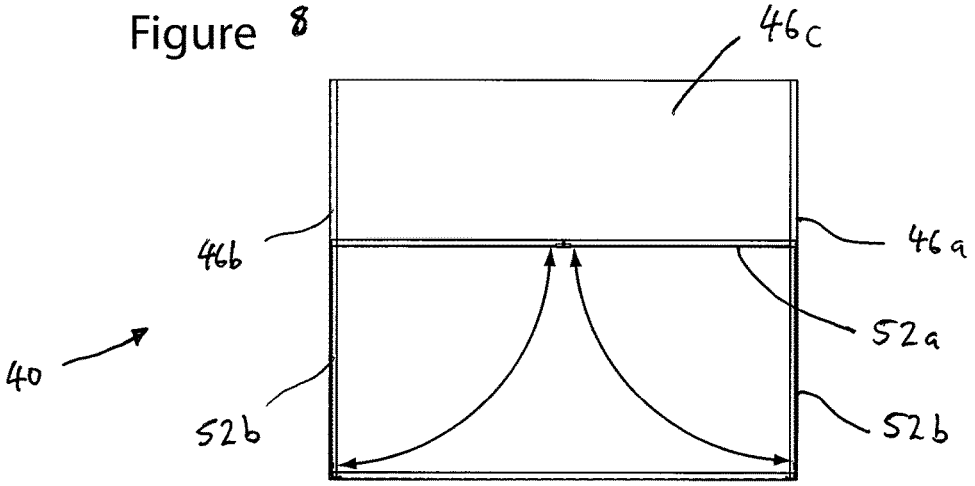
FIG. 8 is a side view of the inlay of FIG. 7 in the first configuration.
Figure 10:
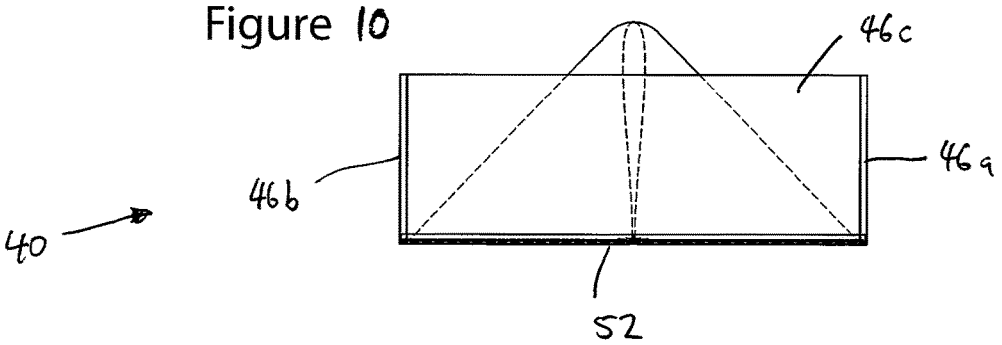
FIG. 10 is a side view of the inlay of FIG. 7 showing the folding of the wall sections.
Figure 12:
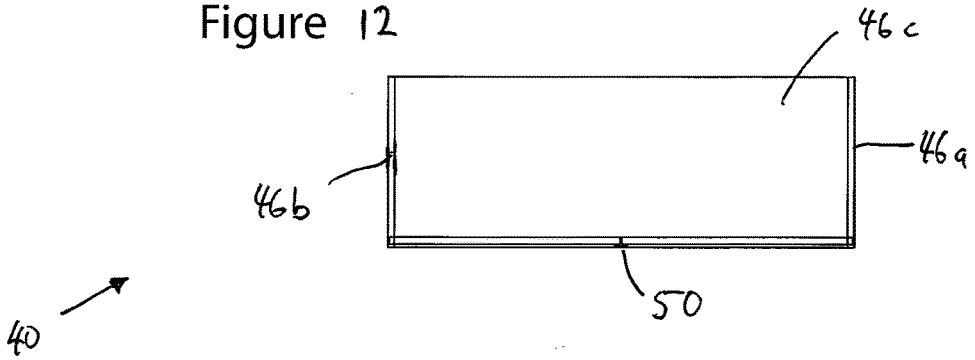
FIG. 12 is a side view of the inlay of FIG. 7 in the second configuration.
Figure 13:
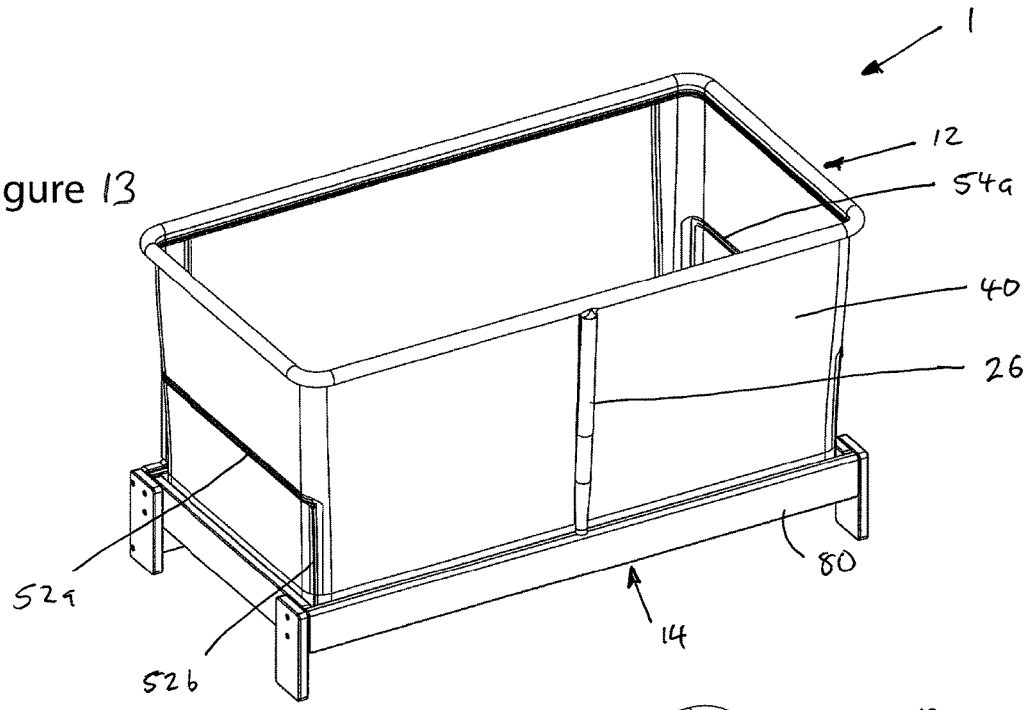
FIG. 13 depicts a perspective view of the first embodiment of a child bed assembly according to the invention in the high-sided child's bed configuration.

In order to transform the inlay from the first configuration to the second configuration, a user simply moves the portions of the wall sections (46) so as to join the respective tracks of the first, second and third zip fasteners (50, 52, 54) together as indicated by the arrows in FIGS. 7 and 8.

Figure 9:
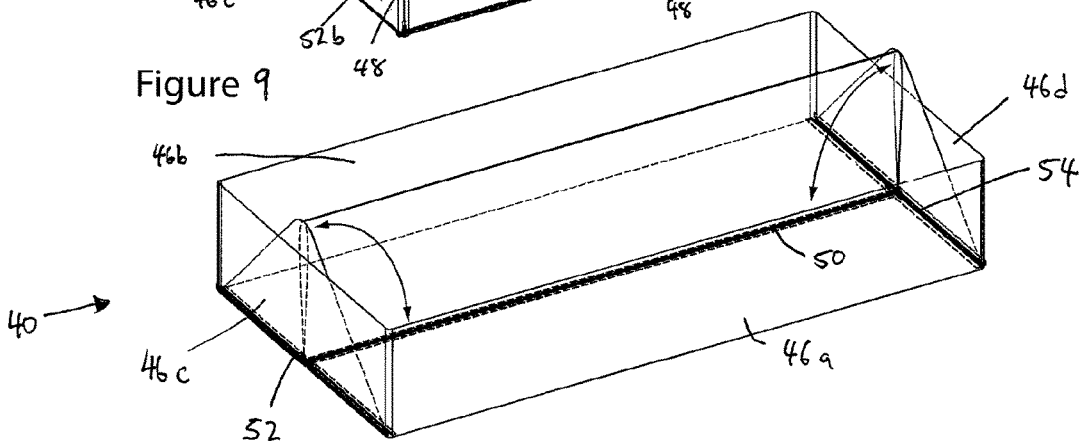
FIG. 9 depicts a perspective view of the inlay of FIG. 7 showing the folding of the wall sections.
Figure 11:
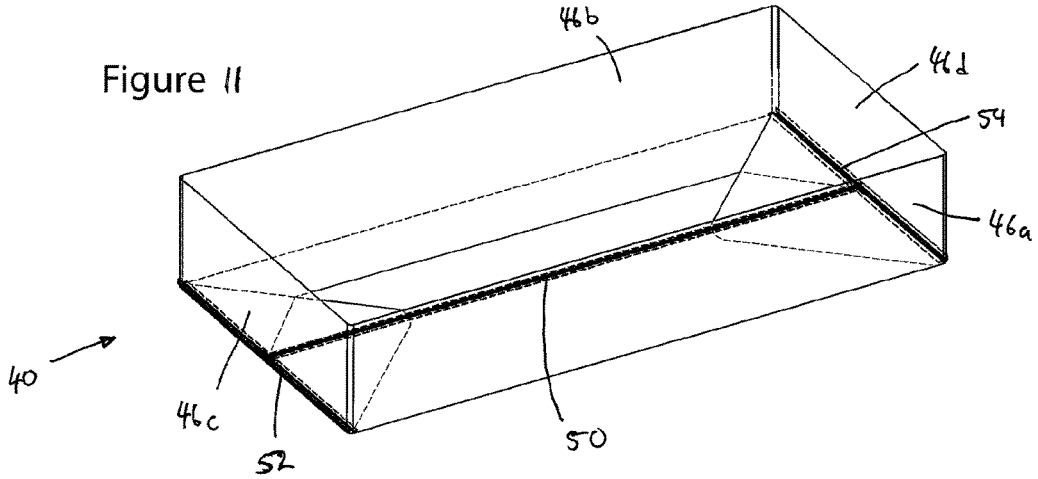
FIG. 11 depicts a perspective view of the inlay of FIG. 7 in the second configuration.

The excess fabric obtained due to bringing the track sections together is then folded as indicated by the arrows in FIG. 9.

The child bed assembly (1) according to the invention can be arranged to be a bassinet, high-sided child's bed or a toddler bed, thus providing a single bed assembly which can be used for a child from birth to toddler.

Figure 14:
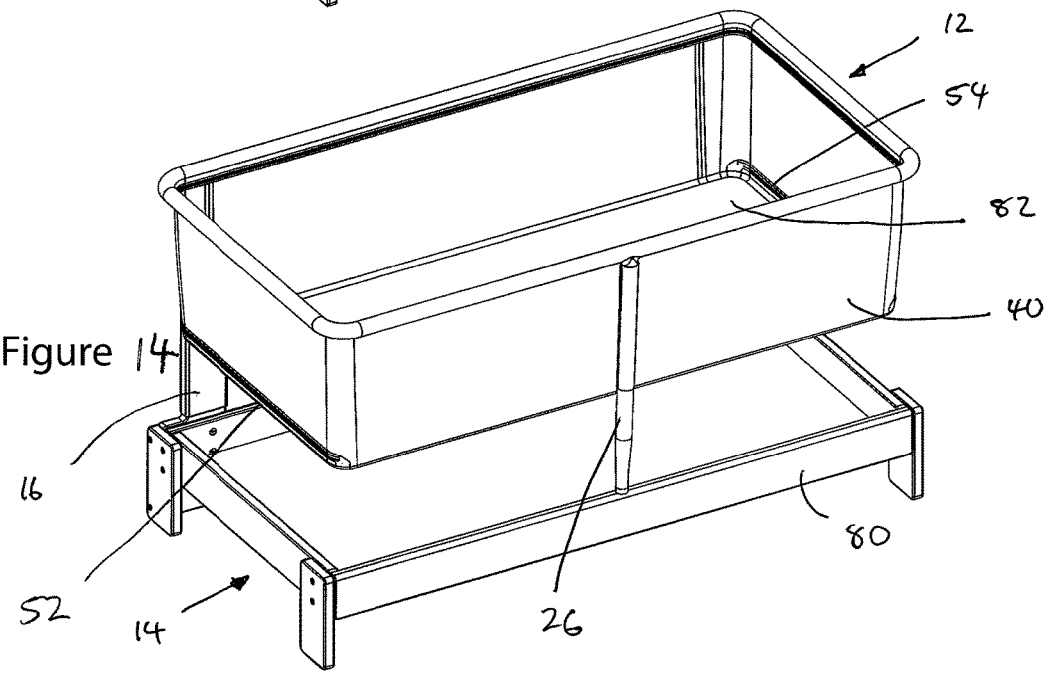
FIG. 14 depicts a perspective view of the first embodiment of a child bed assembly according to the invention in the bassinet configuration.

In order to change the child bed assembly (1) from a high-sided child's bed (see FIG. 13) to a bassinet, a user simply transforms the inlay (40) from the first configuration to the second configuration as described above. The child bed assembly (1) in the bassinet configuration is shown in FIG. 14.

Figure 15:
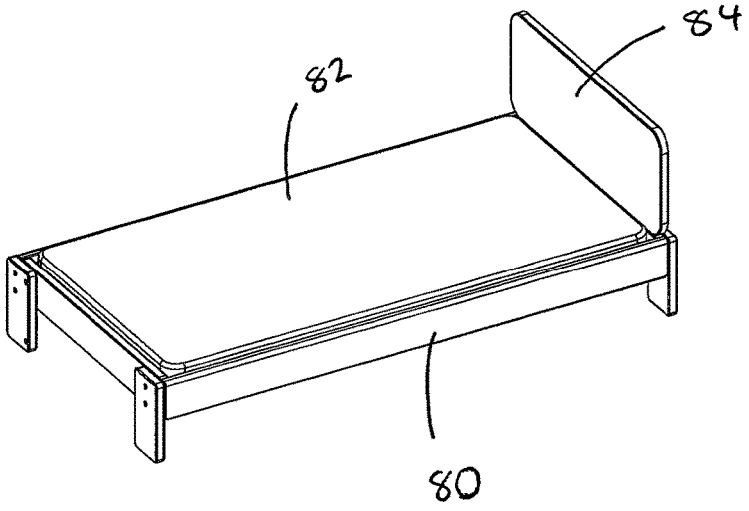
FIG. 15 depicts a perspective view of the first embodiment of a child bed assembly according to the invention in the toddler bed configuration.

When the child becomes too big for the high-sided child's bed and is to be moved to a toddler bed, the required parts of the infant bed frame assembly (10) are removed so as to leave the toddler bed frame (80) as shown in FIG. 15. The child bed assembly (1) may further comprise a headboard (84) which is adapted to be coupled to the toddler bed frame (80) when the child bed assembly (1) is to be used as a toddler bed.

Figure 16:
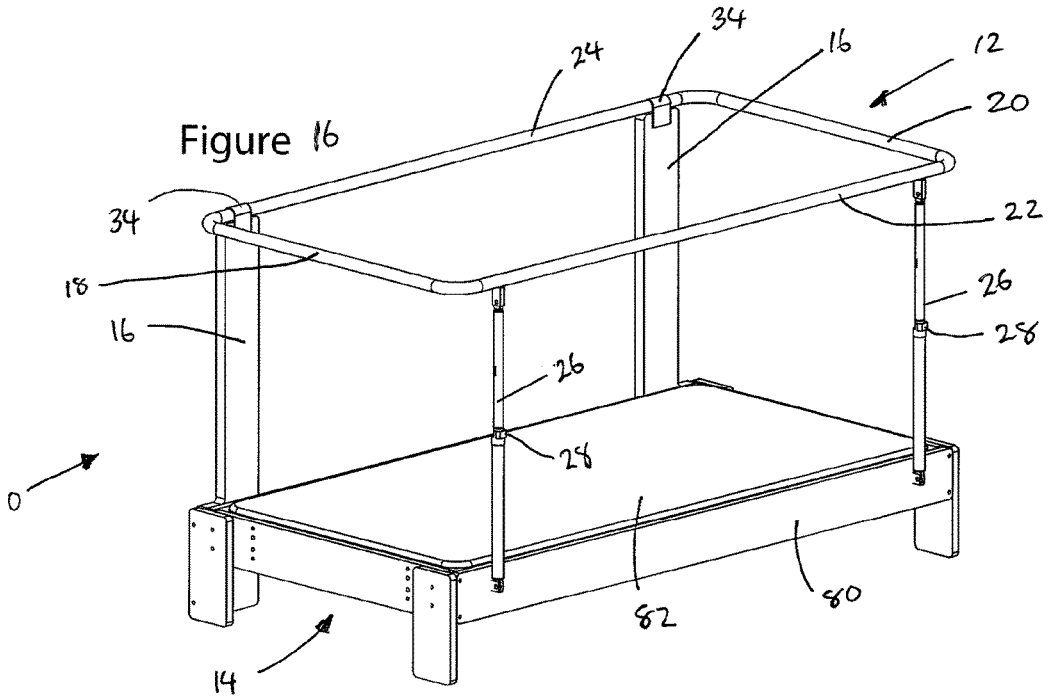
FIG. 16 depicts a perspective view of a second embodiment of an infant bed frame assembly according to the invention with the first crossbar in the first position.
Figure 17:
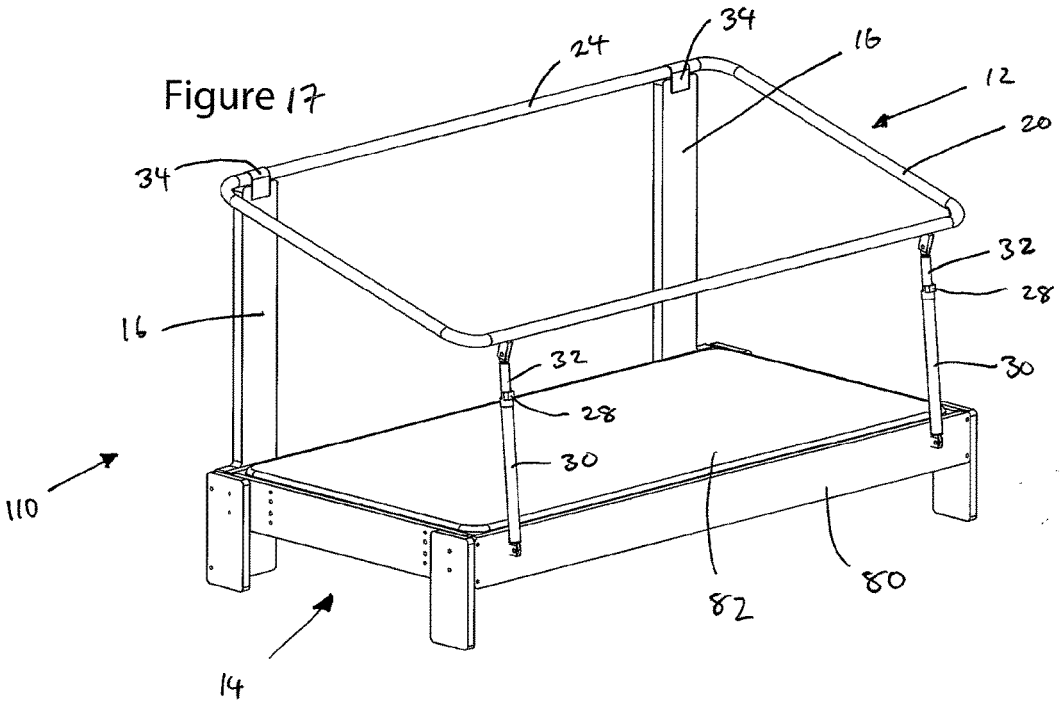
FIG. 17 is a perspective view of the embodiment of FIG. 16 with the first crossbar in the second position.
Figure 18:
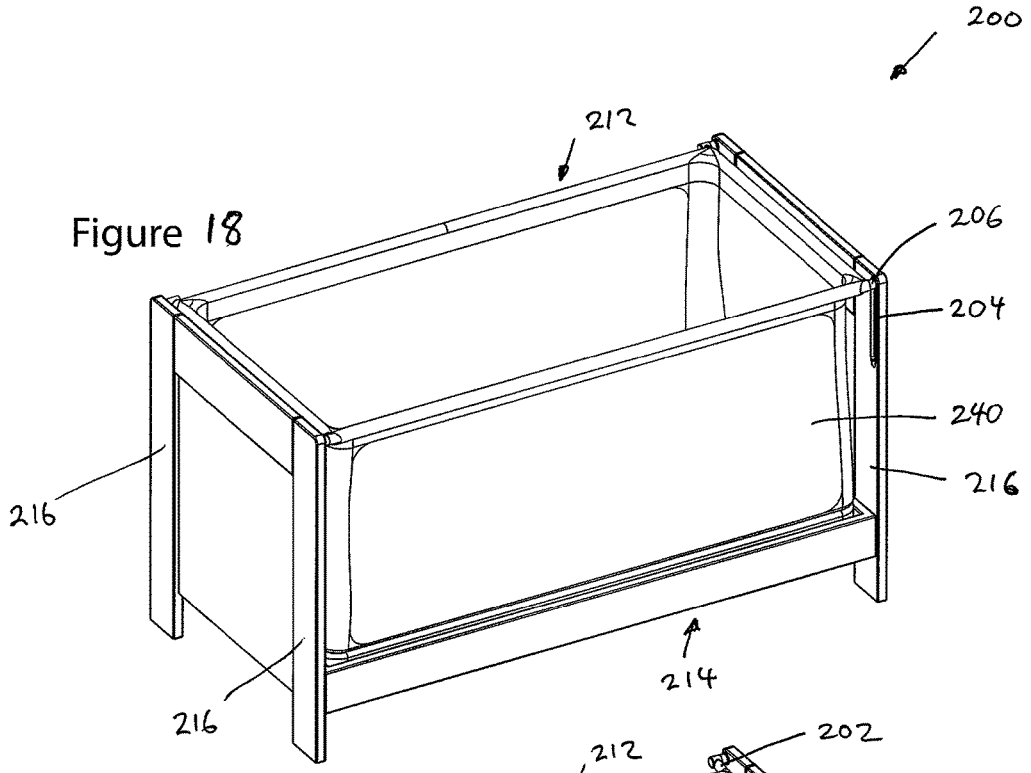
FIG. 18 depicts a perspective view of a third embodiment of a child bed assembly according to the invention with the first crossbar in the first position.
Figure 19:
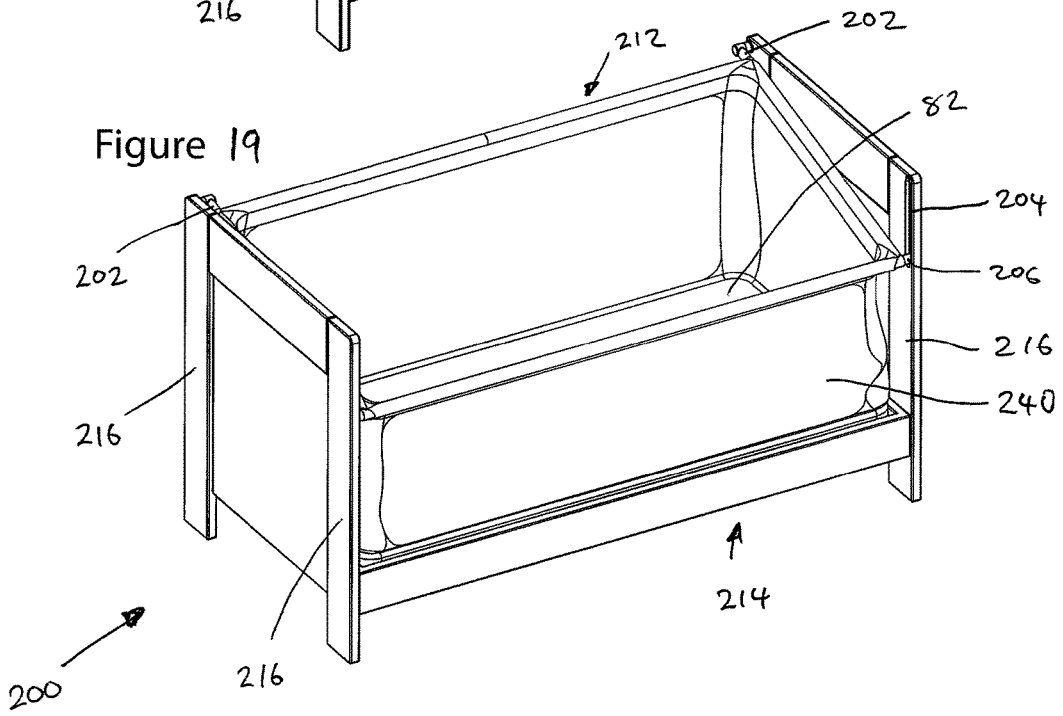
FIG. 19 is a similar view to that of FIG. 18 with the first crossbar in the second position.

Referring to FIGS. 16 and 17, a second embodiment of an infant bed frame assembly in accordance with the invention is shown, generally indicated by reference numeral (110). The infant bed frame assembly (110) is very similar to the embodiment previously described, with the two embodiments only differing in the number and arrangement of the locking struts (26).

In the second embodiment of the infant bed frame assembly (110), the bed frame assembly (110) comprises a pair of locking struts (26) rather than a single locking strut. The locking struts (26) are positioned spaced apart from each other and proximate each end of the first crossbar (22).

Referring to FIGS. 18 to 24, a second embodiment of a child bed assembly according to the invention is illustrated, generally indicated by reference numeral 200.

The same reference numerals have been used for the same features to that of the first embodiment for ease of reference. Reference numerals for similar features to that of the first embodiment have been increased by a factor of 200 for ease of reference, for example the upper frame section which was referred to with reference numeral 12 in the first embodiment will have a reference numeral 212.

The differences between the child bed assembly (200) according to the second embodiment and that of the first embodiment will now be described.

As in the case of the first embodiment, the child bed assembly (200) comprises an infant bed frame assembly (210), an inlay (240) for an infant bed, and a toddler bed frame (280).

The infant bed frame assembly (210) comprises an upper frame section (212), a base frame portion (214) defined by the toddler bed frame and four connecting members (216) connecting the base frame portion (214) to the upper frame section (212). In the embodiment shown, two connecting members (216) are located at the posterior of the infant bed frame assembly (210) and two connecting members (216) are located at the anterior of the infant bed frame assembly (210).

The upper frame section (212) comprises a first sidebar (218), a second sidebar (220), a first crossbar (222) and a second crossbar (224).

The first and second sidebars (218, 220) are spaced apart from each other and are arranged in a substantially parallel arrangement. The first and second crossbars (222, 224)

extend substantially between the first and second sidebars (218, 220) with the first crossbar (222) coupled to the first and second sidebars (218, 220) proximate a first end of each of the first and second sidebars (218, 220) and the second crossbar (224) coupled to the first and second sidebars (218, 220) proximate a second end of each of the first and second sidebars (218, 220). As a result, the first and second sidebars (218, 220) and the first and second crossbars (222, 224) together define a substantially rectangular upper frame section (212).

Figure 20:
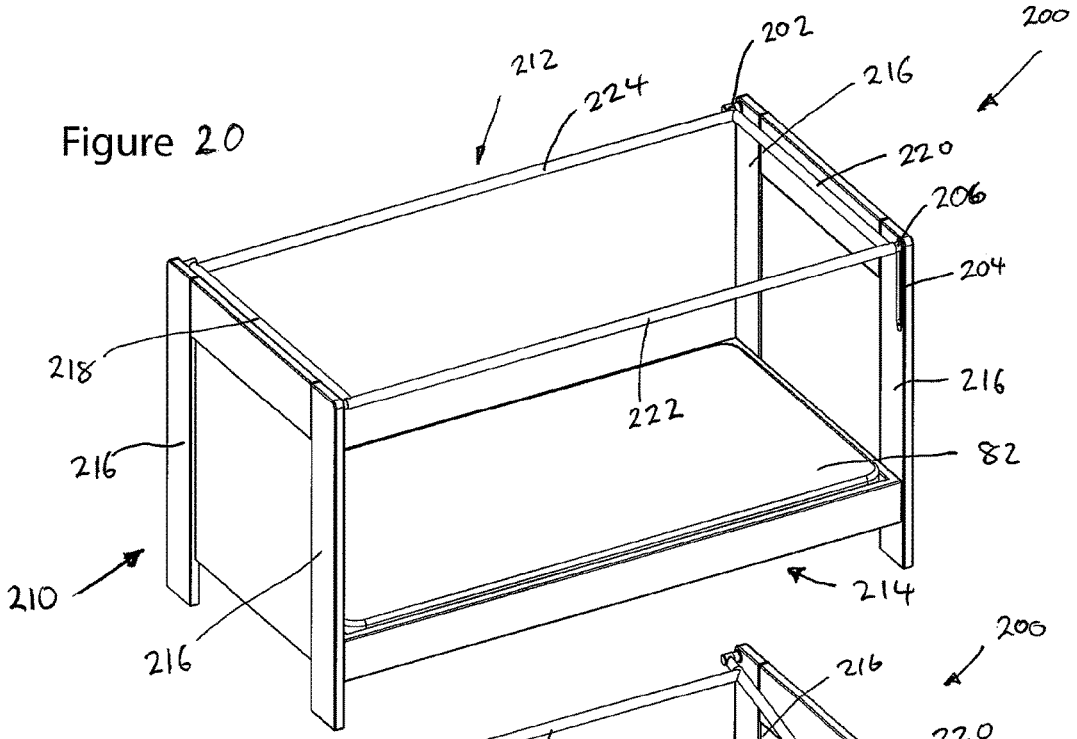
FIG. 20 depicts a perspective view of the third embodiment of the infant bed frame assembly with the crossbar in the first position.
Figure 21:
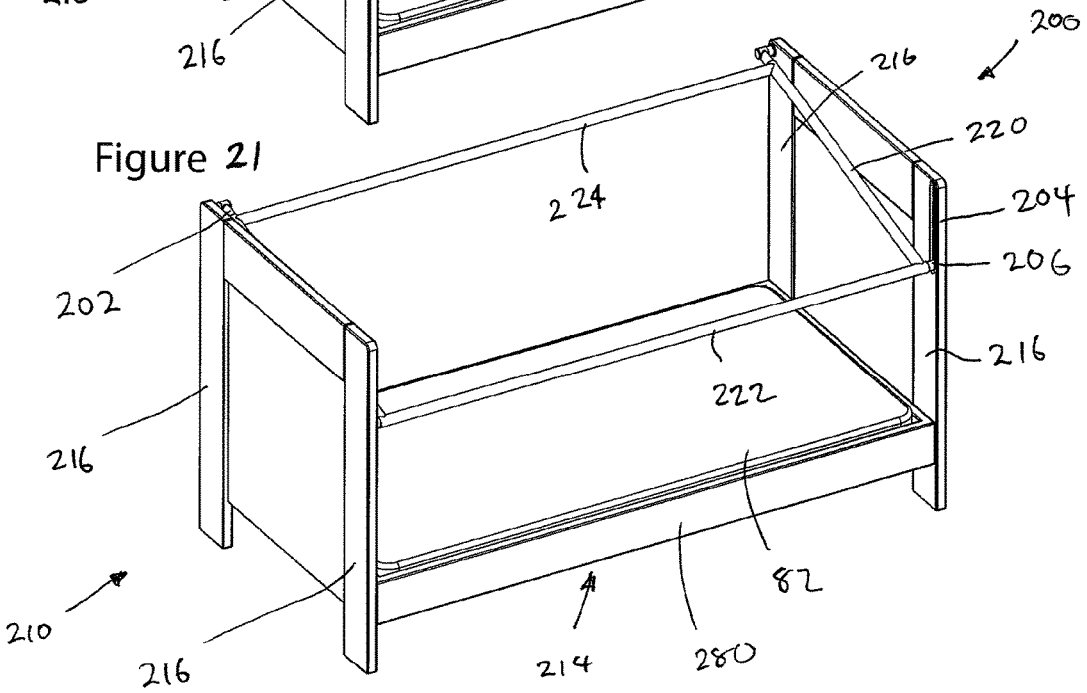
FIG. 21 is a similar view to that of FIG. 20 with the first crossbar in the second position.

The upper frame section (212) is pivotally coupled to the posterior connecting members (216) at the second crossbar (224) by means of connectors (202) which are slidably received in an end of the first and second sidebars (218, 220) (see FIGS. 23*a*, 23*b*, 24*a*, 24*b*). As in the earlier described infant frame assembly embodiments, the first crossbar (222) is movable between a first position wherein the first crossbar (222) is at a first distance from the base frame portion (214) (as shown in FIG. 20) and a second position wherein the first crossbar (222) is at a second distance from the base frame portion (214) (as shown in FIG. 21).

Guide grooves (204) are provided in each of the anterior connecting members (216) and extensions (206) are provided which extend from the end of the first crossbar (222) and are received in the guide grooves (204).

Child proof latches (not shown) are provided which release the first crossbar (222) from a locked first position in order to allow the extensions (206) to slide in guide grooves (204) and lower the first crossbar (222) towards the second lowered position. The child proof latches may also lock the first crossbar (222) in the second position.

The inlay (240) is of similar construction to that previously described above with the difference being that the inlay (240) is designed to fit the upper frame section (212) and comprises openings for the extensions (206) to pass therethrough.

Referring to FIGS. 25 to 32, a third embodiment of a child bed assembly according to the invention is illustrated, generally indicated by reference numeral 300.

The same reference numerals have been used for the same features to that of the first embodiment for ease of reference. Reference numerals for similar features to that of the first embodiment have been increased by a factor of 300 for ease of reference, for example the upper frame section which was referred to with reference numeral 12 in the first embodiment will have a reference numeral 312.

The differences between the child bed assembly (300) according to the third embodiment and that of the first embodiment will now be described.

As in the case of the first embodiment, the child bed assembly (300) comprises an infant bed frame assembly (310), an inlay (340) for an infant bed, and a toddler bed frame (380).

The infant bed frame assembly (310) comprises an upper frame section (312), a base frame portion (314) defined by the toddler bed frame (380) and two connecting members (316) connecting the base frame portion (314) to the upper frame section (312). In the embodiment shown, the two connecting members (316) are located at the posterior of the infant bed frame assembly (310) and are angled towards one another. The two connecting members (316) are connected to one another at an upper edge thereof by a connecting bar (317).

The upper frame section (312) comprises a first sidebar (318), a second sidebar (320), a first crossbar (322) and a second crossbar (324).

The first and second sidebars (318, 320) are spaced apart from each other and are arranged in a substantially parallel arrangement. The first and second crossbars (322, 324) extend substantially between the first and second sidebars (318, 320) with the first crossbar (322) coupled to the first and second sidebars (318, 320) proximate a first end of each of the first and second sidebars (318, 320) and the second crossbar (324) coupled to the first and second sidebars (318, 320) proximate a second end of each of the first and second sidebars (318, 320). As a result, the first and second sidebars (318, 320) and the first and second crossbars (322, 324) together define a substantially rectangular upper frame section (312).

The first sidebar (318), second sidebar (320), first crossbar (322) and second crossbar (324) are made from stainless steel or aluminum and may be integrally formed to define the upper frame section (312) as shown in FIG. 33. It would be understood that other suitable materials may be used to make the components of the upper frame section (312).

Alternatively, the upper frame section (312) may be formed from two 'C' sections joined together, for example by welding, as shown in FIG. 34.

The upper frame section (312) is pivotally coupled to the connecting members (316) at the second crossbar (324) by means of connectors (not shown). The connectors act as pivot locations for the upper frame section (312). As in the earlier described infant frame assembly embodiments, the first crossbar (322) is movable between a first position wherein the first crossbar (322) is at a first distance from the base frame portion (314) (as shown in FIG. 25) and a second position wherein the first crossbar (322) is at a second distance from the base frame portion (314) (as shown in FIG. 26).

The infant frame assembly (300) further comprises a locking strut (326) adapted to lock the first crossbar (322) in the first position. In the embodiment shown, the locking strut (326) is in the form of a gas spring mechanism, for example an Econoloc® gas spring. The locking strut (326) is also adapted to lock the first crossbar (322) in the second position.

Referring to FIGS. 35 to 37, the gas spring mechanism (326) comprises a fixed tube section (330) and a sliding tube section (332). The sliding tube section (332) is in the form of a locking shroud of a gas spring as known in the art. An end of the sliding tube section (332) is coupled to the first crossbar (322) by means of a first connector (370) and an opposite end of the sliding tube section (332) is adapted to receive an end of the fixed tube section (330). An opposite end of the fixed tube section (330) is coupled to the base frame portion (314) by means of a second connector (372).

As can be seen, the locking strut (326) is centrally positioned relative to each end of the first crossbar (322).

The infant bed frame assembly further comprises a release mechanism (328) associated with the locking strut (326). The release mechanism is adapted to release the first crossbar (322) from a locked position so as to be movable towards the second position or first position as required.

In the embodiment shown, the release mechanism (328) is in the form of a push/trigger mechanism which when activated, applies a pressure to the designated area of the sliding tube/locking shroud (332) allowing the gas spring (326) to move relative to the fixed tube section (330).

The release mechanism (328) is coupled to the locking shroud (332) by means of a clamp (374) (see FIG. 35).

A spring (376) and stop (378) are located in the clamp (374) for use with the release mechanism (328).

The release mechanism (328) comprises a pair of prongs (329) at a distal end thereof adapted to rest on either side of the first connector (370). The prongs (329) help prevent the release mechanism (328) from spinning and ensure that it is always positioned relative to the designated area of the locking shroud (332) which pressure needs to be applied to in order to release the locking strut (326) from a locked position.

As in the other described embodiments, in use, in order to move the first crossbar (322) to the second position, a user simply presses the release mechanism (328) and then pushes the first crossbar (322) in a downwards direction. This provides the double action release required under the safety standards.

Due to the fact that the locking strut (326) is centrally positioned, the push button of the release mechanism (328) can be activated by a user's knee when they have a child in their arms, thus only requiring one free hand to release and push the first crossbar (322) towards the second lowered position.

The release mechanism (328) is adapted to lock the first crossbar (322) in the second lowered position.

If the first crossbar (322) is in a locked second position, the release mechanism (328) would need to be first activated for an auto reset function of the gas spring mechanism (326) to function. FIGS. 37(*a*) to (*d*) show the locking strut (326) at different positions with FIG. 37(*a*) depicting the activation of the release mechanism (328); FIG. 37(*b*) depicting the locking strut (326) in a compressed configuration with the release mechanism (328) in a lock state adapted to prevent the extension of the locking strut (326); FIG. 37(*c*) depicting the locking strut (326) in a compressed configuration with the release mechanism (328) in a release state adapted to allow the extension of the locking strut (326); and FIG. 37(*d*) depicting the locking strut (326) in an extended state.

With additional reference to FIGS. 38 to 40, the inlay (340) comprises a base layer (not shown), an opening (344) opposite the base layer (as shown in FIG. 31) and at least one wall section (346) upstanding from the base layer. In the embodiment shown, the inlay (340) comprises four wall sections (346*a-d*) upstanding from the base layer.

A portion of each of the wall sections (346) is foldable so as to transform the inlay (340) between a first configuration wherein the opening (344) is at a first height from the base layer (as shown in FIG. 25) and a second configuration wherein the opening is at a second height from the base layer (as shown in FIG. 27).

In the embodiment shown, the inlay (340) comprises four sections, a top section (390), a first middle section (392), a second middle section (394) and a base section (396).

The top section (390), first middle section (392), second middle section (394) and a base section (396) may be integrally formed or may be made up of different components joined together.

In the embodiment shown, the inlay (340) comprises a fabric and mesh material but may be of any other suitable materials.

The top section (390) is adapted to wrap around the upper frame section (312) and comprises first and second rows of fasteners (391, 393) in the form of claps fasteners, which are adapted to attach the top section (390) to the upper frame section (312).

The top section (390) further comprises a third row of fasteners (399) which are adapted to facilitate the securing of the inlay (340) in the second configuration as required.

In the embodiment shown, the top section (390) is formed from a fabric material and is made up of two parts, a right half and a left half. FIG. 40 depicts an embodiment of a part forming a half of the top section (390).

The first middle section (392) comprises a mesh material in the form of a super fine nylon or synthetic mesh material and is adapted to fold upon itself in order to transform the inlay (340) into the second configuration.

The first middle section (392) is connected to the top section (390) at an edge thereof and to the second middle section (394) at an opposite edge thereof. In the embodiment shown, the first middle section (392) is formed of mesh material in the form of super fine nylon or synthetic mesh. Similar to the top section (390), the first middle section (392) is made up of two parts, a right half and a left half.

The second middle section (394) is at least partially reinforced, that is to say that a portion of the wall sections (346) proximate the base layer is partially reinforced. This allows this portion of the wall sections (346) i.e. the second middle section (394), to substantially maintain its rigidity when the first crossbar (322) is moved to the second position. In this way, the gathering of excess material below the first crossbar (322) when in the second position is limited or avoided, which reduces the risk of a child getting between folds of the inlay.

In the embodiment shown, the second middle section (394) is partially reinforced by means of arch shaped tubes or rods (not shown) at various locations of the wall sections (346). Only the front wall section (346*a*) and two side wall sections (346*b*, 346*d*) need to be reinforced. In would be understood that the second middle section (394) may be partially reinforced by other suitable means.

In the embodiment shown, the second middle section (394) comprises a mesh material and a fabric material, with the arch shaped tubes contained within the fabric material so that they are not visible.

The fabric material comprises a plurality of cut-out sections (347), a row of fasteners (397) which are adapted to be coupled to the third row of fasteners on the top section (390) in order to facilitate the securing of the inlay (340) in the second configuration as required, and a flap (395) that is adapted to fold over the row fasteners (397) when not in use.

A band of mesh material is joined to the fabric material such that the cut-out sections (347) define windows (345) of mesh material in the second middle section.

Similar to the top section (390) and the first middle section (392), the second middle section is made up of two parts, a right half and a left half. FIG. 39 depicts an embodiment of a part forming a half of the fabric portion of the second middle section (394).

The base section (396) is formed of fabric material, for example heavy cotton twill material, and comprises a plurality of slots therein adapted to receive a portion of the reinforcing arch shaped tubes or rods.

A column (398) of material is utilized to join all the left and right sections of the inlay (340) together.

The inlay (340) further comprises a plurality of webbings (360) attached to the underside of the base section (396). In the embodiment shown, the inlay (340) comprises three lengths of webbing (360) sewn to the underside of the base section (396) (see FIGS. 31 and 32).

Each webbing (360) comprises a fastener (362) (shown in phantom in FIG. 31) in the form of a side release buckle, with the male buckle member located at one end of the webbing (360) and the female buckle member located at the opposite end of the webbing (360).

In order to transform the inlay (340) from the first configuration to the second configuration, a user simply folds the first middle section upon itself and connects the third row of fasteners (399) on the top section (390) to the row of fasteners (397) on the second middle section (394).

A second embodiment (not shown) of an inlay for use with the third embodiment of the child bed assembly in accordance with the invention will now be described.

Like the previously described embodiment, the inlay comprises a base layer, an opening opposite the base layer and at least one wall section upstanding from the base layer.

The inlay also comprises four sections, a top section, a first middle section, a second middle section and a base section. The top section, the first middle section, the second middle section and the base section are similar to that of the previously described embodiment.

The two embodiments differ in that the first middle section is configured such that it may be removed in order to transform the inlay from the first configuration to the second configuration, The first middle section in the first configuration is temporally coupled to the second middle section by means of a suitable fastener, for example a zip, a plurality of snap fasteners or hook and loop type fasteners.

The top section of the inlay may be integrally formed with the first middle section or may be separable from the first middle section. If it is separable from the first middle section, then it may be coupled to the first middle section by means of a suitable fastener, for example a zip, a plurality of snap fasteners or hook and loop type fasteners.

In configurations wherein the top section is integrally formed with the first middle section, a portion of the second middle section will be configured to wrap around the upper frame section and comprise suitable fasteners (391, 393) for attaching the portion of the middle section to the upper frame section (312).

The toddler bed frame (380) comprises a slatted base having a plurality of slats (385) on which the mattress 82 is received (see FIG. 30).

The toddler bed frame (380) further comprises a plurality of 'D'-rings (not shown) attached to an inner portion of the bed frame (380) above the plurality of slats (385) and positioned to substantially correspond to the location of webbings (360) of the inlay (340).

A plurality of side release buckle members are attached to the inner portion of the toddler bed frame (380) proximate the 'D'-rings, the plurality of side release buckle members are configured to connect to a male or female buckle member of the webbing (360).

Referring to FIG. 41, the child bed assembly (300) further comprises a bassinet base (386) which is adapted to lay on top of the base layer of the inlay (340) and provide support for the mattress (82) when positioned within the inlay (340).

The bassinet base (386) is formed of a rigid material such as medium-density fibreboard (MDF) or plastic and comprises a plurality of apertures (387) therein. The apertures (387) may be arranged such that they align with the gaps on the slatted base of the toddler bed frame (380).

Referring to FIG. 42, the child bed assembly (300) further comprises a cover (388) which is adapted to cover the slatted base when the child bed assembly (300) is in bassinet mode as shown in FIG. 27. In this way, the under side of the bed assembly (300) can be used for storage with the cover (388) acting as a shelf for items such as toys, nappies, clothes etc.

The cover (388) comprises a plurality of fold lines (389) which allow the cover (388) to be folded away and easily stored when not in use.

As in the previously described embodiments, the child bed assembly (300) according to the invention can be arranged to be a bassinet (see FIG. 27), high-sided child's bed (see FIG. 25) or a toddler bed (see FIG. 28), thus providing a single bed assembly which can be used for a child from birth to toddler.

When in a high-sided child's bed configuration, the webbing (360) is passed through a corresponding 'D'-ring on the base of the toddler bed frame (380) and the ends thereof buckled together as shown in FIG. 31.

In order to change the child bed assembly (300) from a high-sided child's bed to a bassinet, a user simply transforms the inlay (340) from the first configuration to the second configuration as described above (see FIG. 32).

The webbing (360) is then connected to a 'D'-rings and respective buckle member on the toddler bed frame (380) in order to secure the inlay in position and prevent the likelihood of child being pushed out of the bed due to a force being applied to the inlay (340) from underneath the inlay (340).

When the child becomes too big for the high-sided child's bed and is to be moved to a toddler bed, the required parts of the infant bed frame assembly (300) are removed so as to leave the toddler bed frame (380) as shown in FIG. 28. The child bed assembly (300) further comprises a headboard (384) and a pair of auxiliary legs which are adapted to be coupled to the toddler bed frame (380) when the child bed assembly (380) is to be used as a toddler bed.

The pair of auxiliary legs replace legs provided by the connecting members (316) when in the high-sided child's bed configuration.

The invention claimed is:

1. An infant bed frame assembly comprising: an upper frame section; a base frame portion; and at least one connecting member connecting said base frame portion to said upper frame section; said upper frame section comprising a first sidebar, a second sidebar spaced apart from the first sidebar, and a first crossbar coupled to said first and second sidebars proximate a first end of each of said first and second sidebars; wherein said upper frame section is pivotally coupled to said at least one connecting member such that said first crossbar is movable between a first position; and wherein said first crossbar is at a first distance from the base frame portion and a second position wherein said first crossbar is at a second distance from the base frame portion.

2. An infant bed frame assembly according to claim 1, wherein the first crossbar extends substantially between the first sidebar and the second sidebar.

3. An infant bed frame assembly according to claim 1, wherein the upper frame section further comprises a second crossbar opposite the first crossbar, said second crossbar being coupled to said first and second sidebars.

4. An infant bed frame assembly according to claim 3, wherein said first and second sidebars and said first and second crossbars define a substantially rectangular upper frame section.

5. An infant bed frame assembly according to claim 3, wherein the upper frame section is pivotally coupled to said at least one connecting member proximate to the second crossbar.

6. An infant bed frame assembly according to claim 1, wherein the first crossbar is lockable in said first position and the infant bed frame assembly further comprises at least one release mechanism adapted to release the first crossbar from a locked first position so as to be movable towards the second position.

7. An infant bed frame assembly according to claim 6, wherein the first crossbar is lockable in said second position and the at least one release mechanism is adapted to release the first crossbar from a locked second position so as to be movable towards the first position.

8. An infant bed frame assembly according to claim 6, wherein the at least one release mechanism comprises an auto reset function adapted to move the first crossbar from the second position towards a locked first position.

9. An infant bed frame assembly according to claim 6, further comprising at least one locking strut adapted to lock the first crossbar in the first position and/or second position.

10. An infant bed frame assembly according to claim 9, wherein the at least one locking strut is in the form of a telescopic tube mechanism.

11. An infant bed frame assembly according to claim 9, comprising a centrally positioned locking strut.

12. An infant bed frame assembly according to claim 9, comprising a pair of locking struts, each locking strut positioned proximate an end of the first crossbar.

13. An infant bed frame assembly according to claim 1 having a pair of connecting members at a posterior of the infant bed frame assembly.

14. An infant bed frame assembly according to claim 13 further having a pair of connecting members at an anterior of the infant bed frame assembly.

* * * * *